US007353636B1

(12) United States Patent
Anderson et al.

(10) Patent No.: US 7,353,636 B1
(45) Date of Patent: Apr. 8, 2008

(54) ADJUSTABLE SIZE SHUTTER WITH RACK AND PINION TILT MECHANISM

(75) Inventors: Richard N. Anderson, Whitesville, KY (US); Donald E. Fraser, Owensboro, KY (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 466 days.

(21) Appl. No.: 10/827,947

(22) Filed: Apr. 20, 2004

Related U.S. Application Data

(60) Provisional application No. 60/464,889, filed on Apr. 22, 2003.

(51) Int. Cl.
*E06B 7/086* (2006.01)

(52) U.S. Cl. ..... 49/82.1; 49/74.1

(58) Field of Classification Search ..... 49/74.1, 49/82.1, 403

See application file for complete search history.

(56) References Cited

U.S. PATENT DOCUMENTS 2,902,728 A 9/1959 Nardulli
3,180,246 A 4/1965 Johnson
4,294,283 A 10/1981 Scharres
5,052,150 A 10/1991 Chen
5,469,658 A 11/1995 Digianni et al.
6,094,864 A 8/2000 Hsu
6,145,251 A 11/2000 Ricci
6,314,680 B1 11/2001 Buckwalter et al.
6,536,162 B2 * 3/2003 LaMay ..... 49/403
6,810,620 B1 11/2004 Anderson et al.
6,865,847 B2 3/2005 Fraser et al.

* cited by examiner

*Primary Examiner*—Jerry Redman
(74) *Attorney, Agent, or Firm*—Theresa Fritz Camoriano; Guillermo Camoriano; Camoriano and Associates

(57) ABSTRACT

A shutter is provided that utilizes a rack and pinion mechanism for tilting the louvers of the shutter. The rack and pinion mechanism preferably is hidden within the stiles of the shutter. In a preferred embodiment, the louvers of the shutter may be installed and removed without disassembling the assembled frame and rack and pinion mechanism.

19 Claims, 23 Drawing Sheets

Fig 13
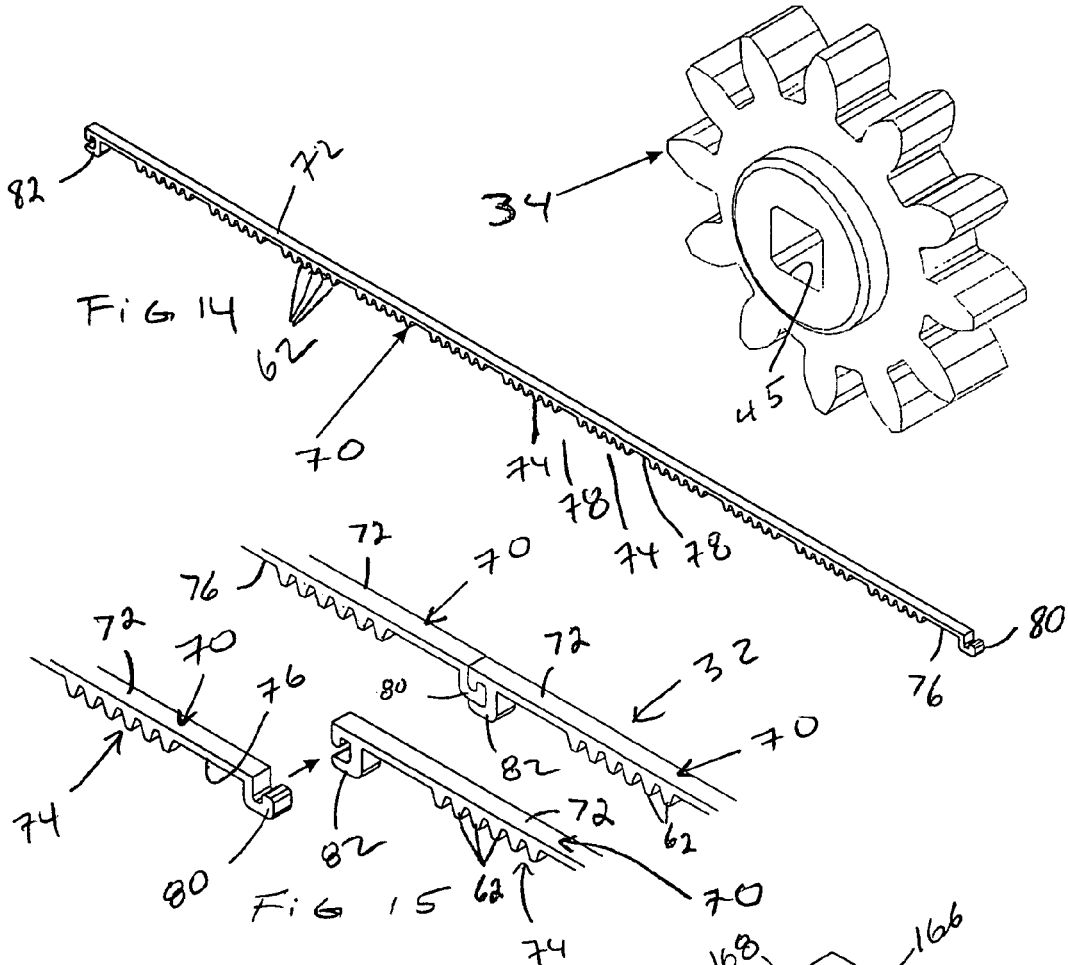
Fig 14
Fig 15
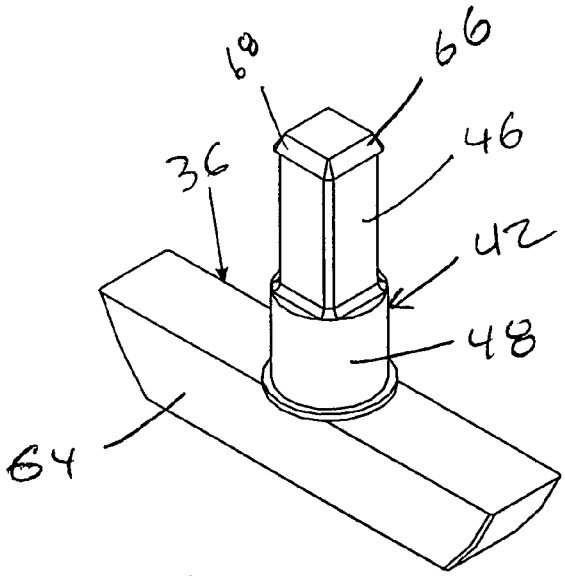
Fig 16
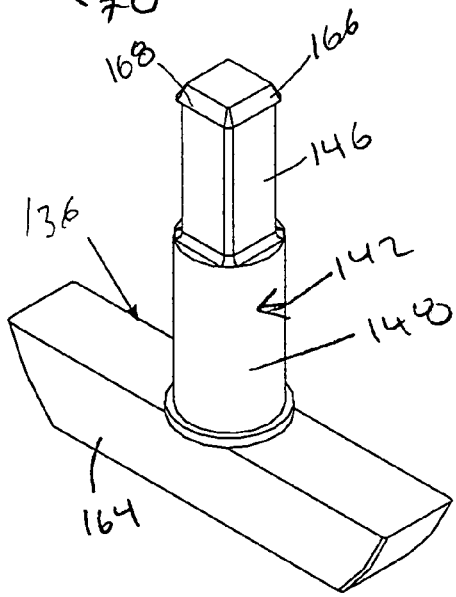
Fig 17

ADJUSTABLE SIZE SHUTTER WITH RACK AND PINION TILT MECHANISM

This application claims priority from U.S. Provisional Application Ser. No. 60/464,889, filed Apr. 22, 2003, which is hereby incorporated by reference.

BACKGROUND OF THE INVENTION

Shutters are designed to cover architectural openings, such windows. Since these openings may come in various sizes, it is desirable to supply shutters which can accommodate varying opening sizes. The present invention addresses the issue of supplying shutters which are readily adjustable to fit into openings of varying height or length. Also, shutters typically include a tilt bar, attached to every louver, for tilting the louvers to an open or closed position. The tilt bar may be considered to detract from the aesthetic appearance of the shutter, and it reduces the viewing area through the shutter. The use of concealed tilt bars and rack and pinion driven louvers is known in the prior art. However, these prior art devices have manufacturing and operational problems.

In typical prior art embodiments of shutters with concealed tilt mechanisms, the louver pin is attached to the louver during the fabricating process and becomes a part of the louver. In many cases, the pins are inserted into round drilled holes in the ends of the louver. This round hole connection generally is unable to transfer a large moment arm between the louver and the pin (as may be required if the tilting movement of a single louver is expected to cause all the other louvers in the shutter to tilt with it). In the prior art, the louvers are assembled into the frame as the frame is being assembled. The failure of a louver (for instance when the pin-to-louver joint fails because the joint is asked to transfer a moment arm which is larger than what it can handle) means that the panel must be dismantled in order to reach and replace or repair the failed part.

SUMMARY OF THE INVENTION

Various improvements over the prior art are provided in various embodiments of the present invention, and not all of the improvements are required in order to be encompassed by the present claims.

One improvement permits easy customization of the height and width of the shutter in an economical, efficient manner.

Another improvement incorporates an improved mechanism for tilting the louvers of the shutter open or closed without the need for a tilt bar, incorporating the louver mounting pins into the louver drive assembly, enabling the louvers to be readily mounted to or removed from the shutter without any further disassembly required.

In one improvement, the portion of the pin which engages the louver is not a traditional round shaft engaging a round hole. Instead, the louver-engaging element of the pin preferably is has an elongated cross-section portion (i.e. rectangular), which fits into a standard woodruff keyhole, and which improves the mechanical drive connection between the pin and the louver. This allows the pin-to-louver connection to transfer a much larger moment arm than is otherwise possible with traditional round pin arrangements. While a woodruff key design was selected because of ease of manufacturing, keys with other elongated cross-sectional shapes could be substituted.

In order to be able to install and remove louvers from an assembled shutter without any further disassembly of the shutter, the stiles may include inwardly biased mounting strips, which are able to retract to allow the louver to disengage from the pin. These mounting strips preferably also incorporate the louver drive assemblies, and they may be pre-manufactured by the primary component manufacturer on highly automated equipment and may be made in standard lengths. The fabricator or end user need no longer take the time to assemble all these components. He may simply take an entire louver drive assembly, cut it to the required length, and install it in its panel. The louver drive assemblies preferably include compression flaps designed to keep each louver drive assembly extended in the retaining groove in the stile to ensure that proper compression is achieved on the ends of each louver in order to minimize the passage of light between the stile and the louvers.

Another improvement allows louvers to be vertically spaced in ⅛ inch increments, which permits customization of the height of the shutter even without the use of light stops along the top and bottom rails.

Another improvement permits a "clutching" action of the louver drive assembly so that the "timing" of all the louvers may be readily adjusted and synchronized after final assembly.

Another improvement provides a slide operator, which is surface mounted on a stile, for tilting the louvers open or closed without having to touch any of the louvers and without the need for a tilt bar.

BRIEF DESCRIPTION OF THE DRAWINGS

FIG. 13 is a perspective view of a pinion gear used in the shutters depicted in FIGS. 1-12;

FIG. 14 is a perspective view of a rack used in the shutters depicted in FIGS. 1-12;

FIG. 15, in the foreground, shows a broken away, detailed, perspective view of two individual rack pieces just before being assembled into a single rack subassembly, and, in the background, shows a rack subassembly comprised of those two individual rack pieces;

FIG. 16 is an enlarged perspective view of one of the woodruff key mounting pins used in the shutter of FIGS. 1-3 and 5;

FIG. 17 is a perspective view of one of the woodruff key mounting pins used in the shutter depicted in FIGS. 4 and 6;

DESCRIPTION OF THE PREFERRED EMBODIMENTS

Figure 1:
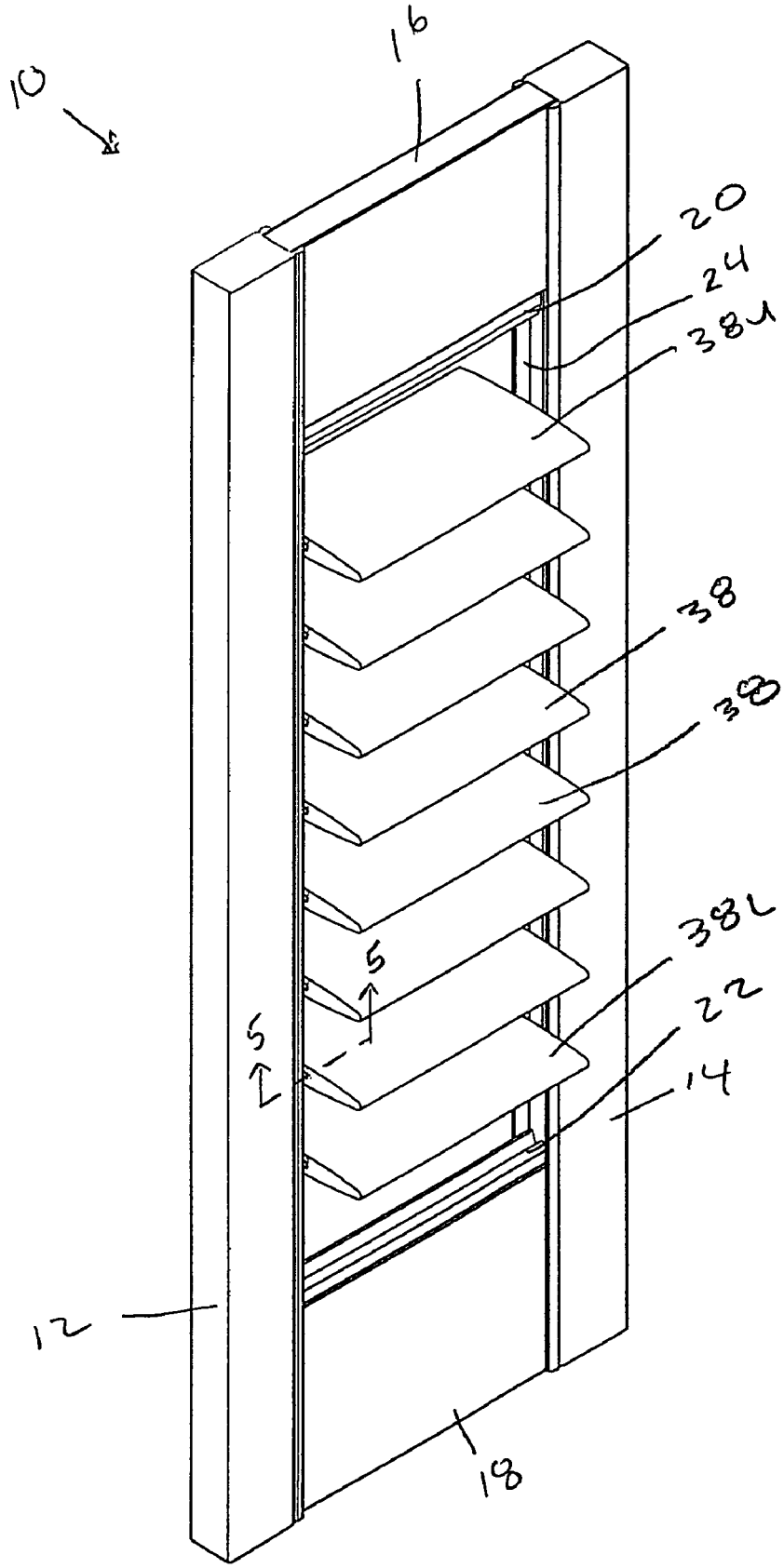
FIG. 1 is a perspective view of a first embodiment of a shutter made in accordance with the present invention, shown with the louvers in the open position.
Figure 2:
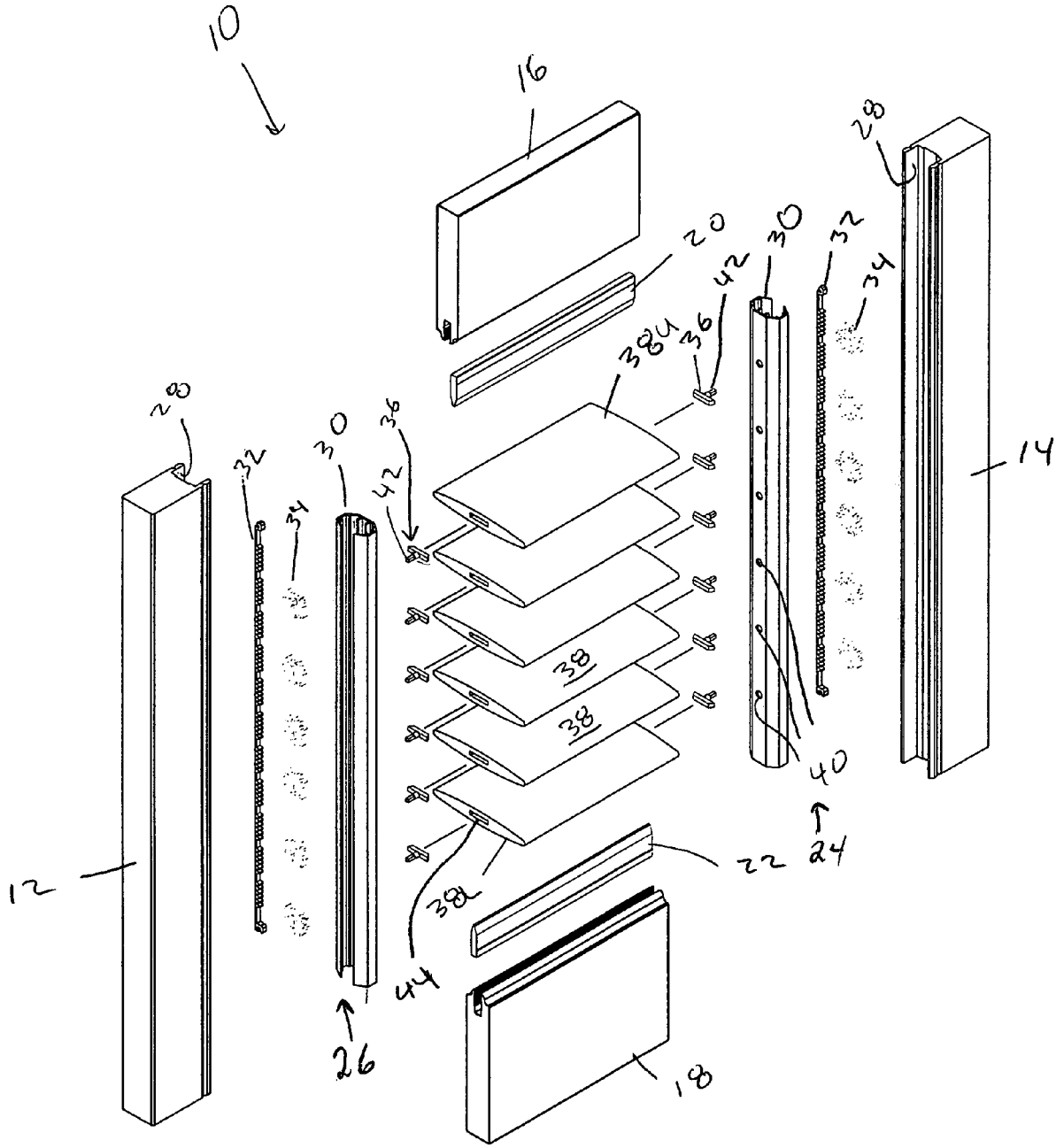
FIG. 2 is an exploded perspective view of the shutter of FIG. 1.

FIGS. 1 and 2 show a first embodiment of a shutter 10 made in accordance with the present invention. The shutter 10 includes left and right vertical stiles 12, 14 and upper and lower horizontal cross rails 16, 18, which are secured together to form a substantially rectangular frame. Upper and lower light stop strips 20, 22 are mounted on the upper and lower cross rails 16, 18. As described in more detail later, identical left and right louver strip assemblies 24, 26 (See also FIGS. 7 and 8) are inserted into U-shaped recesses 28 in the stiles 12, 24 (wherein each louver strip assembly 24, 26 includes a louver strip 30, a rack subassembly 32, a plurality of pinion gears 34, and a plurality of woodruff key mounting pins 36). A plurality of louvers 38 is pivotably mounted to the louver strip assemblies 24, 26. The pivot axes for the louvers 38 are defined by spaced-apart holes 40 in the louver strips 30 and by the pin portions 42 of the woodruff key mounting pins 36, which extend into the holes 40 and into their respective pinion gears 34, as explained later. The substantially rectangular frame, which is formed by the stiles 12, 14 and cross rails 16, 18 has an inner perimeter (the inside of the frame), and the louvers 38 are located within this inner perimeter. The light stop strips 20, 22 project vertically inwardly from the inner perimeter and are recessed from the front face or rear face of their respective cross rails 16, 18, so that the uppermost and lowermost louvers 38U and 38L can close in a generally vertical direction, abutting against their respective light stop strips 20, 22. It is also possible to form the light stops as an integral part of the cross rails 16, 18, as is known in the art.

This shutter 10 is generally used to cover architectural openings, such as windows, and these openings may come in a variety of sizes. Altering pre-finished components of a shutter to adjust the width is not generally a problem. The cross rails 16, 18 may be cut to extend across the desired width of the opening, and these cut ends are covered by the vertical stiles 12, 14, so they do not show. Likewise, the louvers 38 may also be cut to the desired length, and end caps (not shown) may be placed over the ends of the louvers 38 to finish off the cut ends. The end caps may also provide a mechanism to pivotably mount the louvers 38 to the stiles 12, 14, or a new key hole 44 may be cut into the side of the louver 38 for mounting to the woodruff key mounting pins 36. Similarly, the vertical stiles 12, 14 may be cut to fit a particular height dimension. The light stops 20, 22 may be adjustable, as described in U.S. patent application Ser. No. 10/305,491, Adjustable Height Shutter, filed Nov. 27, 2002, which is hereby incorporated by reference, in order to help adjust the shutter 10 to the size of the opening. Also, as described below, the number of louvers 38 and even the pitch (spacing between the louvers 38) may be selected to adjust the shutter 10 to the size of the opening in accordance with the present invention.

Figure 4:
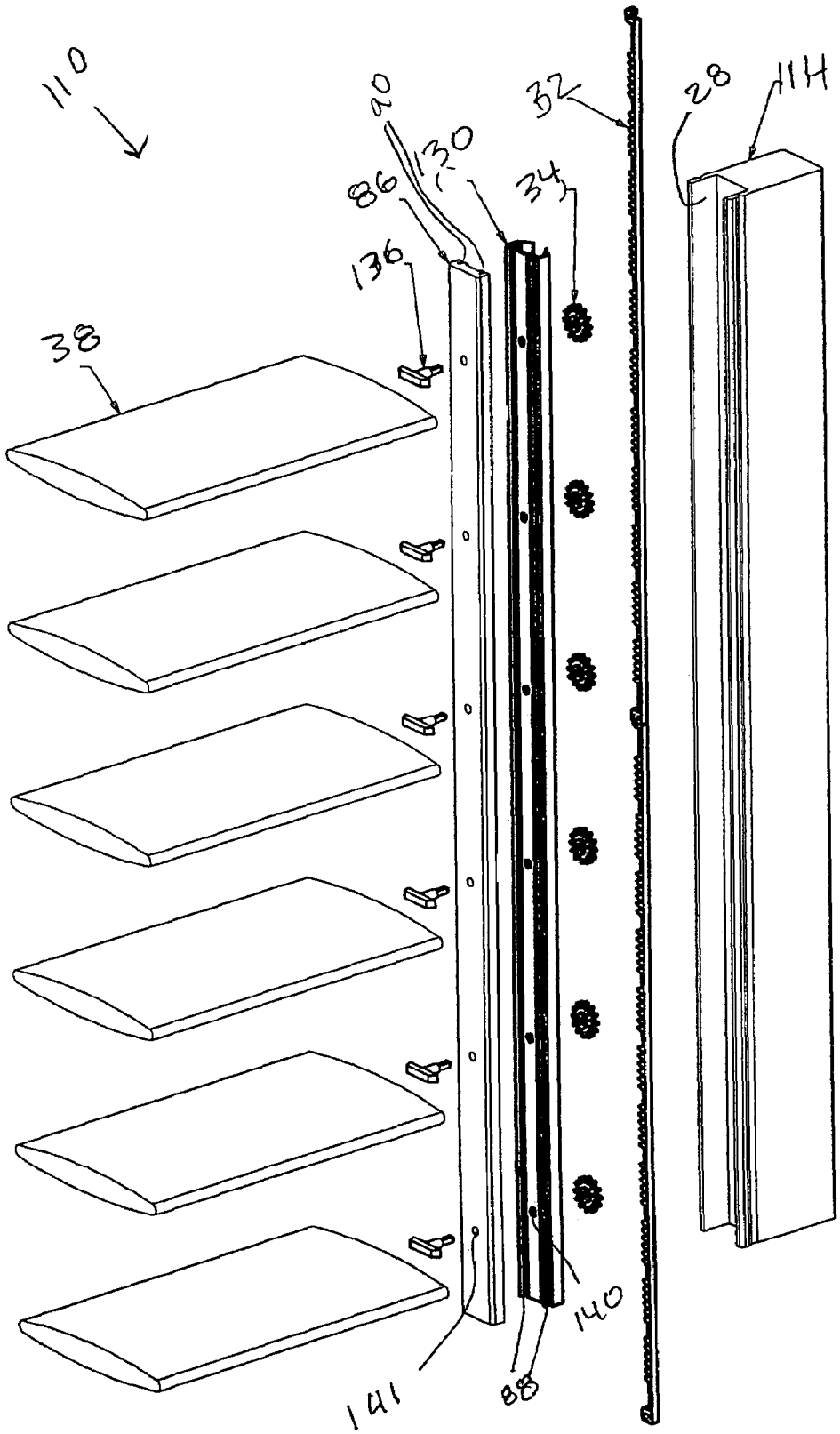
FIG. 4 is a broken away, exploded perspective view, similar to that of FIG. 3, of another embodiment of a shutter made in accordance with the present invention.
Figure 5:
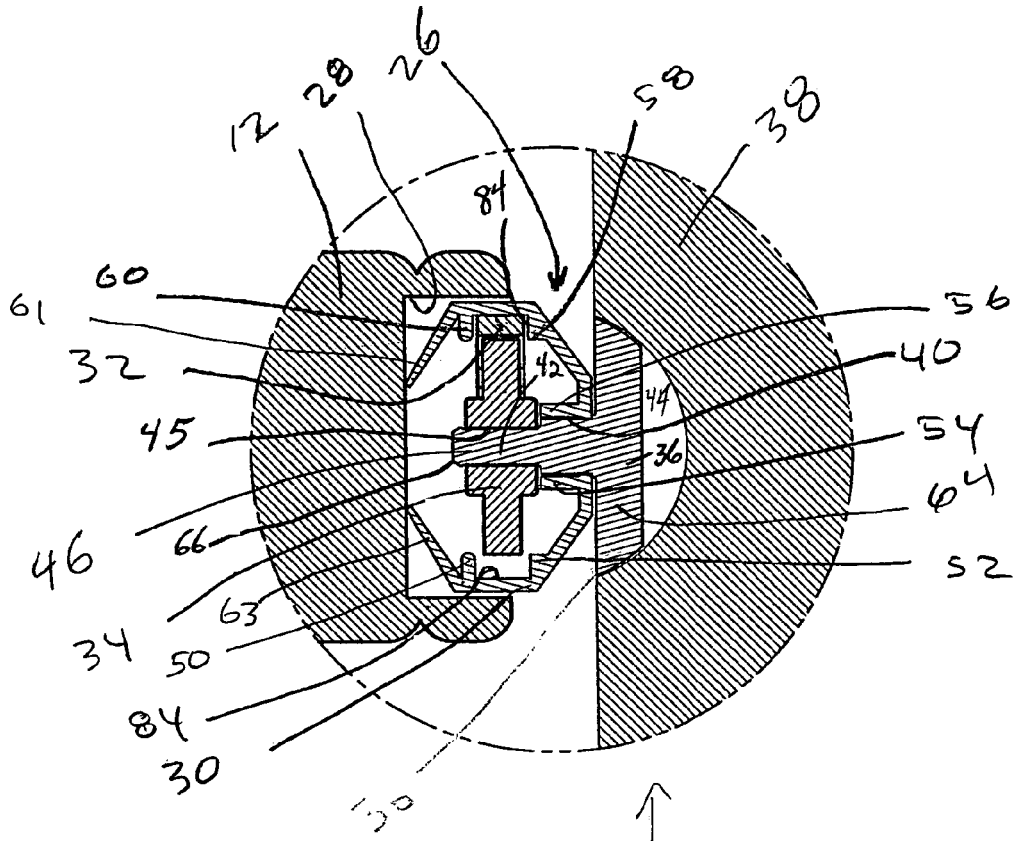
FIG. 5 is an enlarged section view taken along line 5-5 of FIG. 1, but with the louvers in the closed position, showing the stile, louver strip, rack, pinion gear, louver mounting pin, and louver.

The right stile 14 is shown in more detail in FIG. 4. In this embodiment, the right stile 14 is a mirror image of the left stile 12. Each stile 12, 14 is a rectangular, elongate element defining a U-shaped recess 28 extending the full length of one side of the stile. As shown in FIG. 2, each of these recesses 28 receives the respective ends of the upper and lower rails 16, 18, and it receives the louver strip assembly 24 or 26. FIG. 5 is a section view showing the louver strip assembly 26 received in the left stile 12, with the woodruff key 36 received in the louver 38. The woodruff key 36 has a flat, elongated cross-section, with tapered ends. It fits into a corresponding thin, arcuate slot in the end of the louver 38, which may be cut with a circular saw blade. The tapered ends of the woodruff key 36 permit it to be self-centering in the arcuate slot 44 The louver strip assembly 24 is shown in more detail in FIGS. 7 and 8. The louver strip assembly 24 includes a louver strip 30, a plurality of pinion gears 34

(shown in more detail in FIG. 13), a rack subassembly 32 (shown in more detail in FIGS. 14 and 15), and a plurality of woodruff key mounting pins 36 (shown in more detail in FIG. 16).

Referring now to FIG. 5, the louver strip 30 is a hollow, "C" shaped, elongate member with internal ribs 50, 52, 54, 56, 58, 60 (See FIG. 5) extending along the full length of the louver strip 30, and with two integral extension legs 61, 63 which also extend the full length of the louver strip 30 and which partially enclose the open side of the louver strip 30. The louver strip 30 preferably is made from a relatively flexible material, such as plastic. The extension legs 61, 63, in particular, are made from an elastic material which allows them to flex inwardly when force is exerted against them, but which tends to return back to its original position, so that the extension legs 61, 63 thus function as springs or biasing means, which bias the louver strip 30 away from its respective stile 12, 14. The ribs 50, 52, 54, 56, 58, 60 provide structural rigidity to the louver strip 30 and serve to locate and support the rack subassembly 32, the gears 34, and the mounting pins 36, as explained later.

The pinion gear 34 (shown best in FIG. 13) is designed to mesh with the teeth 62 of the rack subassembly 32, and defines a non-circular axial opening 45 for receiving the similarly profiled non-circular shaft portion 46 of the woodruff key mounting pin 36. Referring now to FIG. 16, the woodruff key mounting pin 36 includes a pin portion 42 and a woodruff key portion 64. The pin portion 42 includes a first section 48, which lies adjacent the woodruff key portion 64, and which has a circular cross section, so it may turn smoothly inside one of the circular cross-section holes 40 in the louver strip 30 (see FIG. 2). As was explained earlier, the second section 46 of the pin portion 42 has a non-circular cross-section which mates with the non-circular cross-section of the opening 45 in the pinion gear 34, so the mounting pin 36 rotates with its respective gear 34. The holes 40 in the louver strip 30 are vertically aligned, and, as shown in FIG. 5, the holes 40 are located between the internal ribs 54, 56, which serve to support and journal the mounting pins 36 for rotation within their respective holes 40.

As shown in FIGS. 5 and 16, at the free end of the pin portion 42 is a square cap 66 with tapered or ramped shoulders 68 on all four sides. The cap 66 tapers from a smaller dimension at its end to a larger dimension adjacent the square shaft portion 46, with an abrupt shoulder adjacent the shaft portion 46. The shoulder portion 68 has larger dimensions than the second section 46 and slightly larger dimensions than the opening 45 in the pinion gear 34, so the cap 66 can deform slightly to slide through the axial pinion gear opening 45, and then, once it has passed through the gear 34, it snaps back to its original shape, using a snap fit to lock the woodruff key mounting pin 36 into its respective pinion gear 34, thereby retaining, the pin 36 and gear 34 on the louver strip 30. (Since the woodruff key 64 and the gear 34 are both larger than the hole 40 on the louver strip 30, the pin 36 cannot be removed from the louver strip 30 without disassembling it from the pinion gear 34.) Alternative retaining mechanisms could be used instead, such as a retaining ring, or a cotter pin, for example, but this arrangement is preferred.

The woodruff key portion 64 of the woodruff key mounting pin 36 releasably attaches the respective louver 38 to the respective stile 12, 14. The woodruff key mounting pin 36 is preferably made from a high strength material, such as zinc, to handle the high stresses of transmitting the torque required to tilt the louvers 38 in the shutter 10 and still allow for a small bearing surface to reduce friction between the pin portion 46 and its journaling surface (the perimeter of the hole 40 and the ribs 54, 56) on the louver strip 30.

The rack subassembly 32, as shown best in FIGS. 14 and 15, is made up of a plurality of rack pieces 70. Each rack piece 70 is an elongate member with a smooth first side 72 and with toothed sections 74 on its opposite side 76. The toothed sections 74, each including a plurality of teeth 62, are separated by smooth or untoothed sections 78. The first end of each rack piece 70 terminates in a hooked projection 80, and the second end of each rack piece 70 terminates in a hooked receptacle 82, which receives and interlocks with the hooked projection 80 of the adjacent rack piece 70 to form a continuous rack subassembly 32. Each rack piece 70 preferably is made from a flexible material, such a plastic.

Looking now at FIG. 5, which shows the rack subassembly 32 mounted in the louver strip 30, it can be seen that the width of the rack subassembly 32 (and therefore of each rack segment 70) is such that the rack subassembly 32 fits snugly in the channel 84 that is formed between the internal ribs 58, 60 of the louver strip 30. The thickness of the rack assembly 32 (meaning the distance between the walls 72, 76) and the distance between the opening 40 and the channel 84 are such that the pinion gears 34 engage the teeth of the rack subassembly 32 when the rack subassembly 32 is installed in the channel 84.

Referring again to FIGS. 14 and 15, showing the rack 70, the toothed sections 74 and the gaps or spaces 78 in between the toothed sections 74 allow for spacing of the louvers 38 onto the louver strips 30 at standard 2 inch, 3 inch, and 4 inch pitches. Another embodiment of a rack 70' (See FIGS. 26 and 27), which will be described in detail later, has a continuous set of teeth, without spaces. This rack 70' allows for spacing of the louvers 38 onto the louver strips 30 at as little as ⅛ inch increments.

Figure 33:
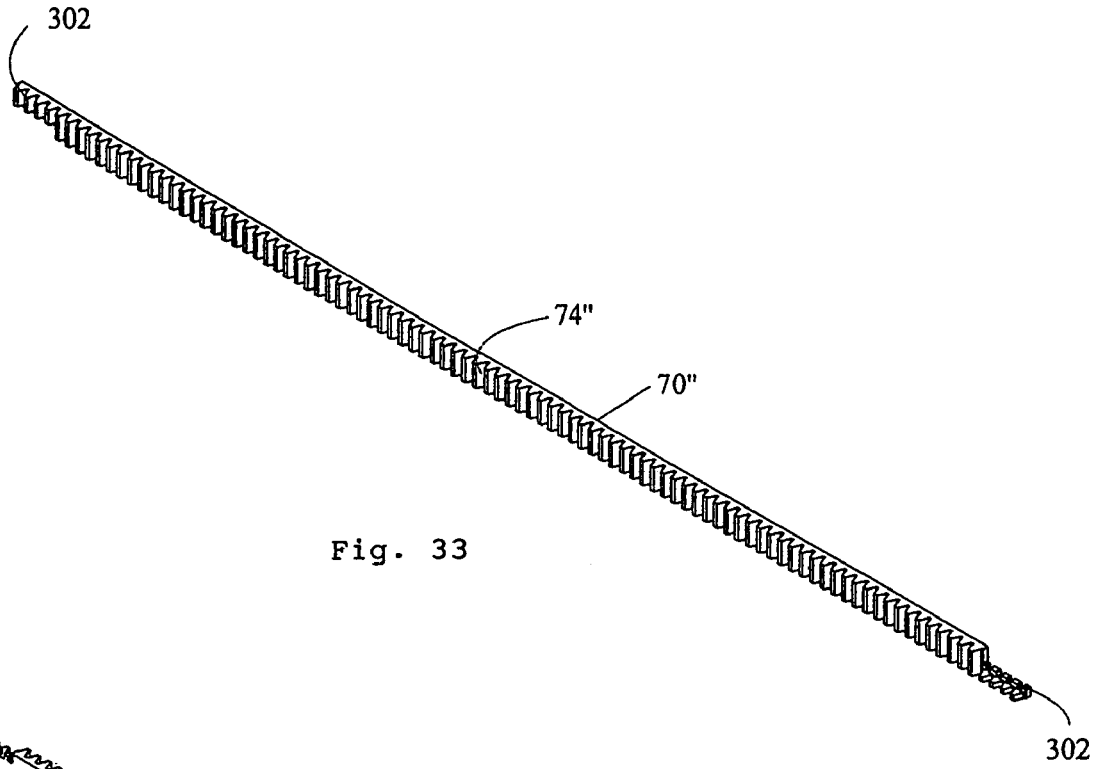
FIG. 33 is an opposite-side perspective view of the gear rack of FIG. 32.
Figure 32:
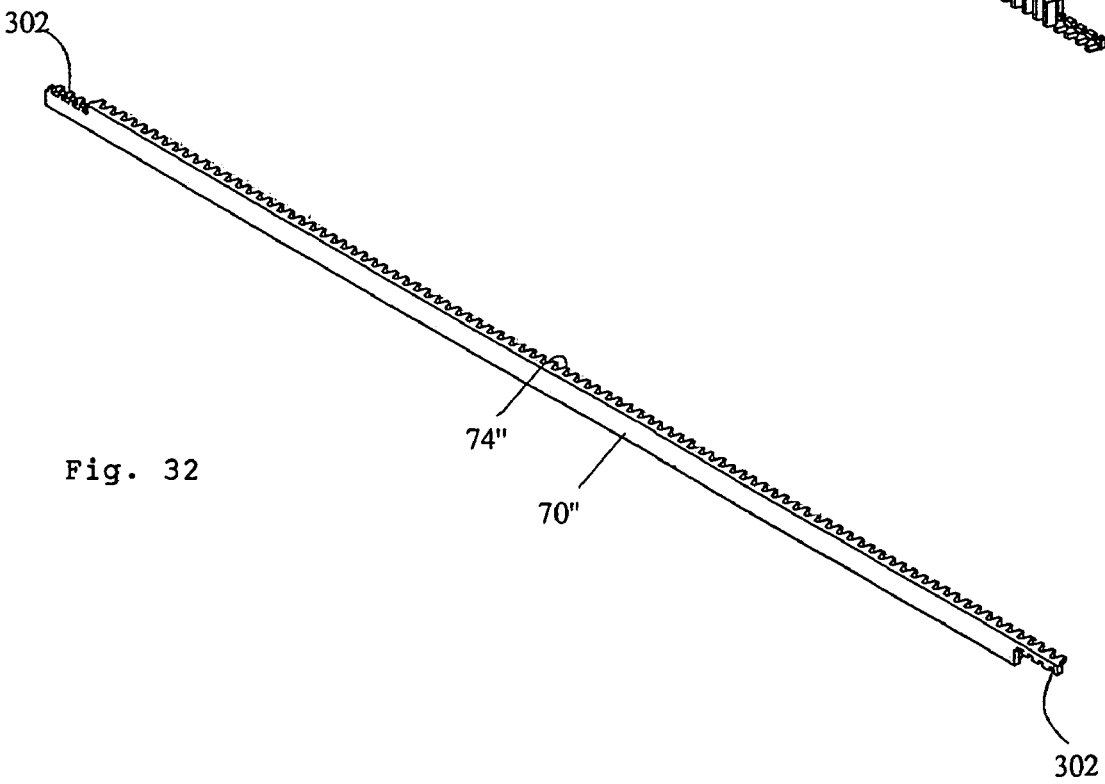
FIG. 32 is a perspective view of another embodiment of gear rack which may be used in any of the previously described embodiments of a shutter made in accordance with the present invention.

Yet another embodiment of a rack 70" (See FIGS. 32 and 33) also has a continuous set of teeth without spaces, like the rack 70', but the hook 80 and receptacle 82 have been eliminated in favor of intermeshing teeth 302 at each end of each rack segment. These intermeshing teeth 302 are on a surface which lies along the longitudinal dimension of the rack 70" and which is substantially perpendicular to the front toothed surface 74" of the rack 70" such that, when the two ends 302 of adjoining rack segments 70" are brought together, they may overlap to form what appears to be one continuous toothed gear rack assembly. As described for the rack assembly 32, when this new embodiment of a rack assembly is installed in a louver strip 30, it can be seen that the width of the rack assembly (and therefore of each rack segment 70") is such that the rack assembly fits snugly in the channel 84 that is formed between the internal ribs 58, 60 of the louver strip 30. The ribs 58, 60 keep the individual rack segments 70" pinched together at their ends 302 to maintain the integrity of the entire rack assembly.

Assembling the Louver Strip Assemblies

Figure 3:
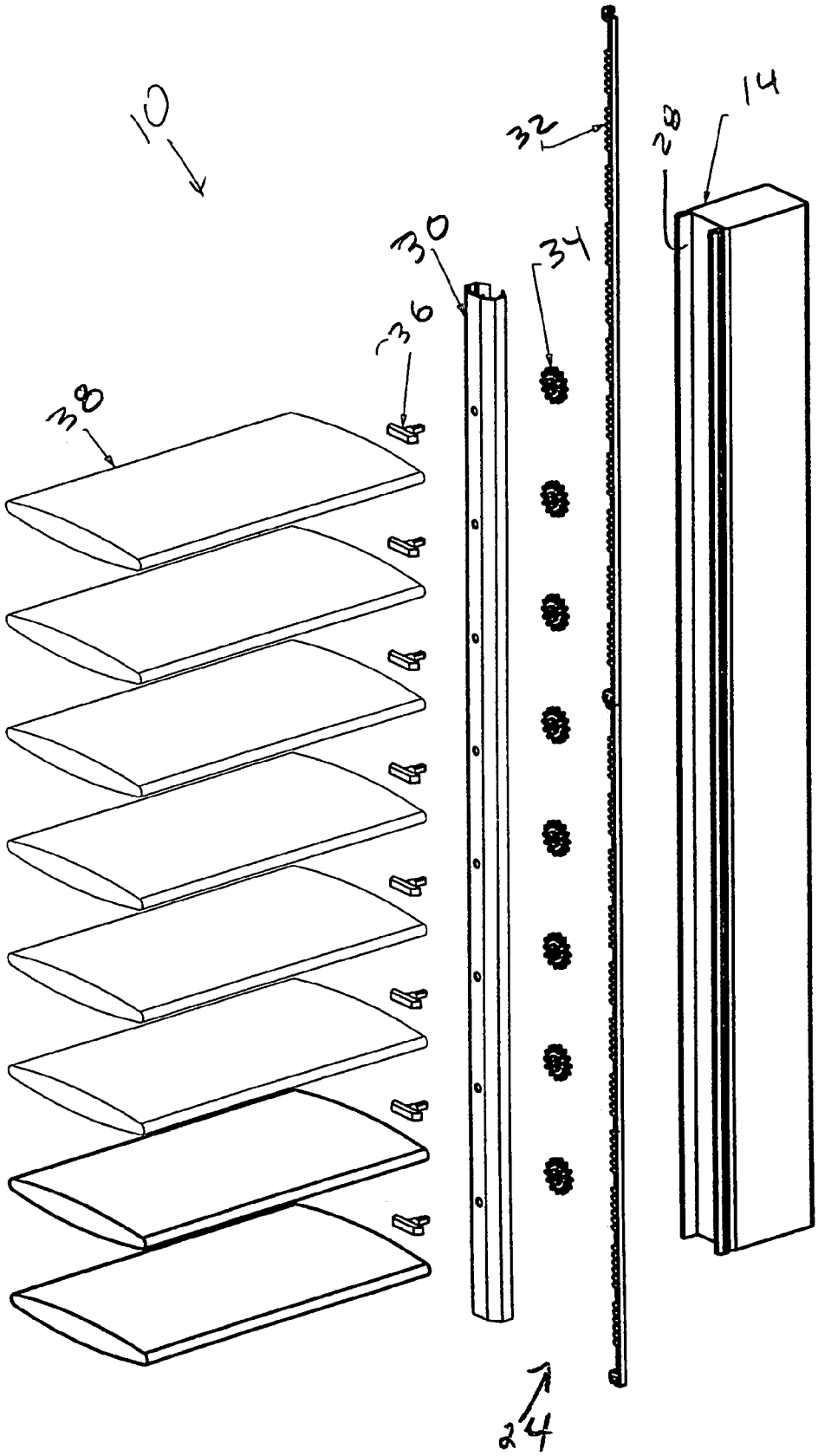
FIG. 3 is an exploded perspective view of the right end of the shutter of FIG. 2, with the louvers broken away.

Each louver strip assembly 24 (or 26) of FIGS. 2, 3, and 5 is put together by first assembling a plurality of rack segments 70 into a rack subassembly 32 as shown in FIG. 14. In the present embodiment, each rack segment 70 is 12 inches long. Once the desired length of the rack subassembly 32 is reached, roughly long enough to match the length of the louver strip 30 in which it is to be installed, the rack subassembly 32 is mounted in the channel 84 formed by the internal ribs 58, 60 of the louver strip 30. Since the louver strip 30 is symmetrical, the rack subassembly 32 could alternatively be installed in the opposite channel 84 formed by the internal ribs 50, 52, or louver strips 30 could be installed in both of the opposed channels 84 on a louver strip 30. It may be desirable to use rack assemblies 32 in both opposed channels 84 when the shutter is extra large, in order for the forces on the teeth of the pinion gear 34 and on the teeth of the rack assemblies 32 to be divided between the two rack assemblies 32.

Figure 7:
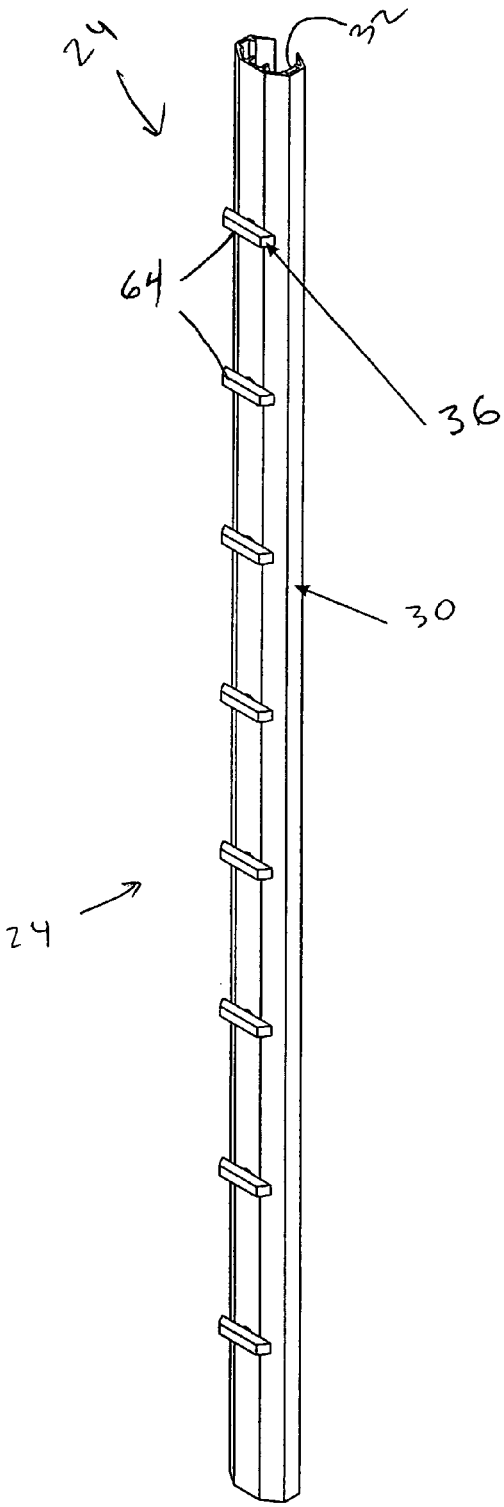
FIG. 7 is a perspective view of the louver strip assembly (including the louver strip, the rack, the pinion gears, and the louver mounting pins) of the shutter of FIGS. 1-3.
Figure 8:
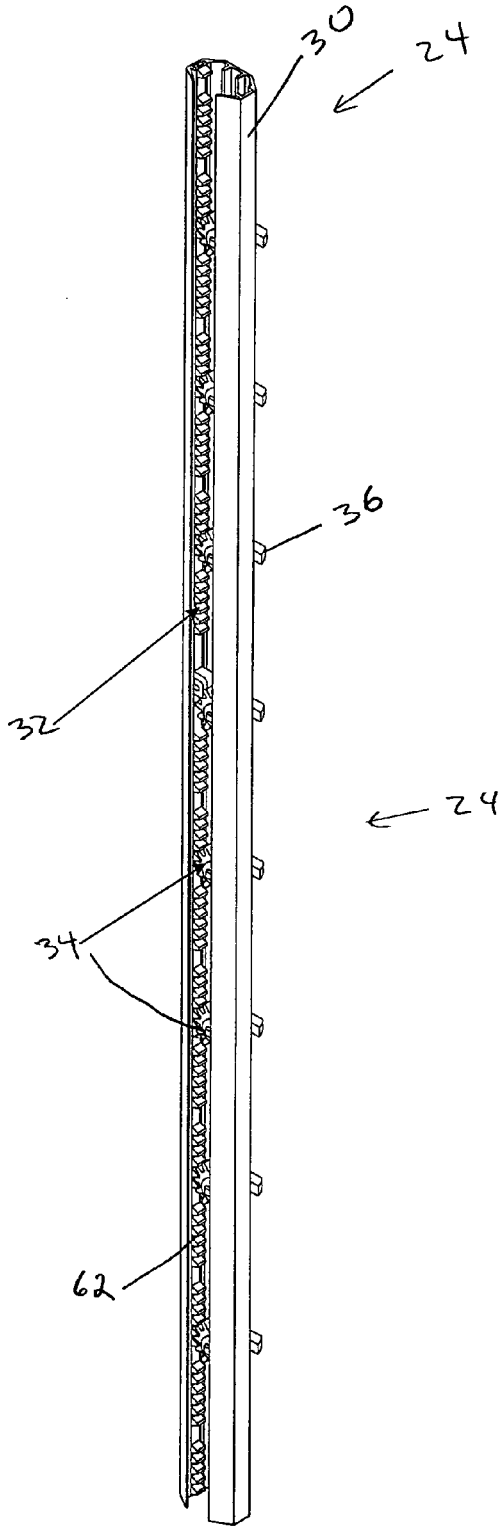
FIG. 8 is a perspective view of the back side of the louver strip assembly of FIG. 7.

The louver strip 30 preferably will have the holes 40 predrilled for the desired louver pitch (standard pitches are 2 inch, 3 inch, and 4 inch), and a pinion gear 34 is mounted on a woodruff key mounting pin 36 at each hole 40, aligning the opening 45 of each gear 34 with the a hole 40 in the louver strip 30. In order to mount each pinion gear 34, the pin portion 42 of the respective woodruff key mounting pin 36 is inserted from outside the louver strip 30 through its respective hole 40 and then through the axial opening 45 of its respective gear 34. Once the cap 66 reaches the other side of the gear 34, it locks the woodruff key mounting pin 36 and the gear 34 in place on the louver strip 30. Care should be taken to make sure that the key portions 64 of all the woodruff key mounting pins 36 are oriented in the same direction relative to the louver strip 30, as shown in FIG. 7, where all the key portions 64 are oriented horizontally.

Assembling the Shutter

To assemble the shutter 10, the upper and lower rails 16, 18 are cut so that the overall width of the shutter 10, when assembled, is the required width to cover the architectural opening. Similarly, the stiles 12, 14 are also cut to the required length to cover the architectural opening. A frame is assembled with the rails 16, 18 and the stiles 12, 14, with the ends of the rails 16, 18 inside the "U" shaped recesses 28 of the stiles 12, 14. The light stops 20, 22 (if used) are also cut to the same overall length of the rails 16, 18 and are inserted into their corresponding channels along the rails 16, 18, projecting inwardly into the frame.

The height dimension between the bottom of the top light stop 20 and the top of the bottom light stop 22 is measured (or between the bottom of the top cross rail 16 and the top of the bottom cross rail 18 if no light stops 20, 22 are used). A determination is made as to the best fit for the stack of louvers 38. The pitch of the louvers 38 preferably is a standard 2 inch pitch, 3 inch pitch, or 4 inch pitch, and the light stops 20, 22 may be adjustable light stops (as disclosed in the previously referenced "Adjustable Height Shutter" application) or may even be completely eliminated. Then, the louver strips 30 are cut to fit within the measured height dimension.

Note that the factory may ship pre-assembled louver strip assemblies 24 with the correct louver pitch, and the fabricator or end user would then choose the louver strip assemblies 24 with the correct pitch for the application and cut them to the required length, or the factory may ship all the components for the louver strip assembly 24 (the louver strip 30 without any predrilled holes, the racks 70, the pins 36, and the gears 34) for the fabricator or end user to drill the holes 40 in the louver strip 30 at the desired pitch, and then assemble the louver strip assembly 24 as has already been described. Note also that the louver strip assemblies 24, 26 may be cut to length to fit between the light stops 20, 22, or they may be cut a bit longer, to fit between the upper and lower rails 16, 18, in which case the light stops 20, 22 may be cut a bit shorter to fit between the louver strip assemblies 24. Alternatively, the louver strips 30 may have a notch cut (routed) into them at both ends to accommodate the light stops 20, 22.

Once the louver strip assemblies 24, 26 have been cut to the desired length, the woodruff key mounting pins 36 are rotated so that the woodruff key portions 64 are oriented vertically (simulating the louvers in a fully closed position, room side up), and any part of the rack subassembly 32 which projects beyond the end of the louver strip assembly is cut off. The woodruff key mounting pins 36 are then rotated 180 degrees so that the woodruff keys are once again oriented vertically (simulating the louvers in a fully closed position, room side down), and again any part of the rack subassembly 32 which projects beyond the end of the louver strip assembly is cut off. The louver strip assemblies 24, 26 are then inserted in the "U" shaped recesses 28 in their corresponding stiles 12, 14, with the woodruff key portions 64 projecting inwardly.

Figure 22:
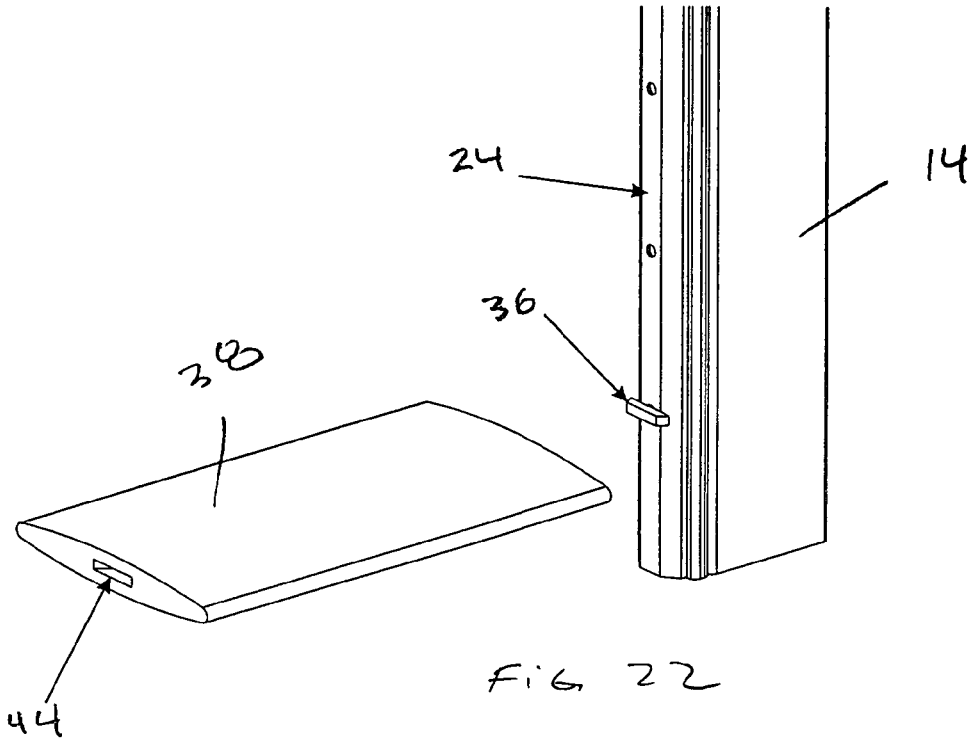
FIG. 22 is a broken away, partially exploded, perspective view of a style, louver strip assembly, and a louver of the shutter shown in FIG. 1.
Figure 23:
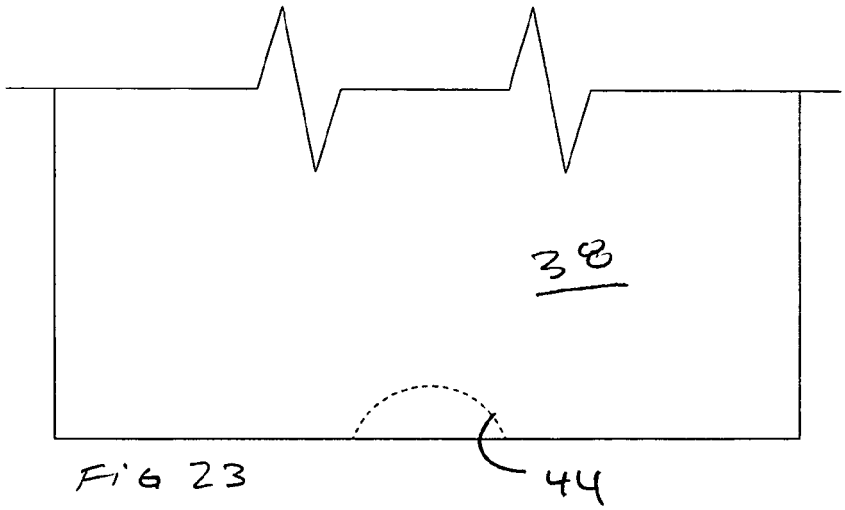
FIG. 23 is a broken away, plan view of the louver of FIG. 22, with the key hole shown in phantom.
Figure 24:
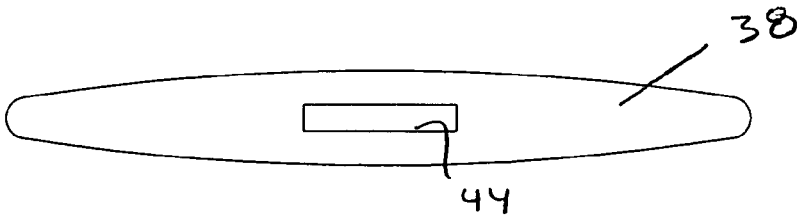
FIG. 24 is an end view of the louver of FIG. 22.

The distance between the opposing faces of the two installed louver strips 30 is measured, and the louvers 38 are all cut to a length corresponding to that distance by trimming off one end of each of the louvers 38. Then, a new keyhole 44 is cut into the trimmed end of each of the louvers 38 (See FIGS. 22, 23 and 24). While woodruff keys are not required (woodruff keys are well known in the industry; they are flat, elongated keys with arcuately-tapered ends), they do have several advantages. One of the advantages of using woodruff keys is that it is a fairly simple procedure to cut the arcuate notch to form the keyhole 44 using a standard woodruff cutter tool. The woodruff key 64 also is self-centering in the arcuate keyhole 44. The key 64 and the keyhole 44 also have a fairly large contact surface area to be able to transmit the torque forces (moment arm) required to rotate the entire stack of louvers 38. This large contact surface area also provides sufficient frictional resistance between the key 64 and the louver 38 to make it unnecessary to glue or otherwise secure the key 64 to the louver 38. If the louvers 38 are hollow, or even if they are not hollow but it is not desirable to have the fabricator or end user cut the keyhole 44, then end caps (not shown) may be provided which snap on or otherwise attach to the ends of the louvers 38, wherein the end caps already have the keyhole 44 formed or cut into them.

Figure 25:
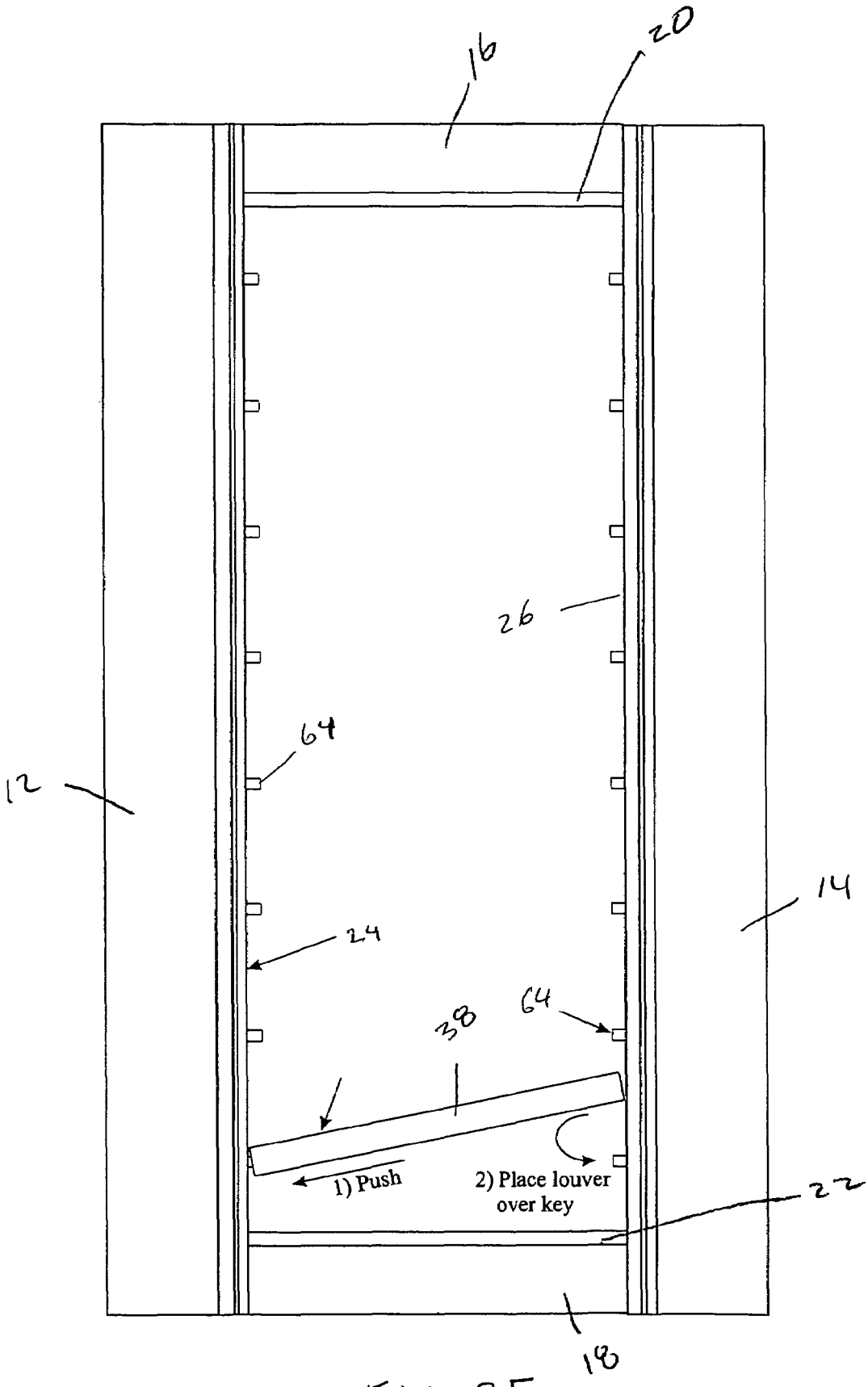
FIG. 25 is a schematic sketch of a frame for a shutter made in accordance with the present invention, showing the procedure for installing the louvers onto the shutter frame.

The final assembly step for assembling the shutter 10 is shown schematically in FIG. 25. With the frame assembled, the light stops 20, 22 in place (if light stops are used), and the louver strip assemblies 24, 26 installed, each louver 38 is mounted to its respective pair of keys 64. Starting at the left stile 12, a louver 38 is mounted so that the key 64 from the left louver strip assembly 26 slides into that louver's left keyhole 44. The louver 38 is then pushed toward the left against the left louver strip assembly 26, causing the biasing leg extensions 61, 63 of that assembly to flex, and causing the entire left louver strip assembly 26 to move outwardly, toward the left. While the left louver strip assembly 26 is in this retracted or depressed position, the installer pushes the right louver strip assembly 24 outwardly toward the right stile 14, causing the leg extensions 61, 63 of the right louver strip 30 to flex, which moves the corresponding right key 64 to the right, far enough for the louver 38 to be lowered until the right keyhole 44 of that louver 38 lines up with its respective right key 64. As both the louver 38 and the louver strip assembly 24 in the right stile 14 are released, the key 64 slides into the right keyhole 44 of the louver 38, holding the louver 38 securely and rotatably in place. This procedure is repeated with each of the louvers 38 until all the louvers 38 are installed. The reverse of this procedure may be employed at any time to remove the louvers 38 from the shutter 10, since the louvers 38 are not glued or otherwise permanently secured to the keys 64. (The louvers 38 may be glued or otherwise more permanently secured to the keys 64, if so desired.) Assuming that the louvers 38 are not glued into place, they may be removed from the frame without damaging or in any way destroying the louvers 38 or the frame or the louver strip assemblies 24, 26, simply by reversing the installation process described above and shown in FIG. 25. Note that the installation and removal of the louvers 38 may start on the left hand side as described or at the right hand side, as desired.

Once assembled, the shutter 10 of FIG. 1 is simple to operate. The user grabs any one of the louvers 38 and rotates it about the axes of its mounting pins 36. As the left and right woodruff key mounting pins 36 for that louver rotate along with the louver 38, they cause their respective rack subassemblies 32 to move up or down, depending upon the direction of rotation of the louver 38. This causes the other pinion gears 34 to rotate. The rotating gears then cause their respective woodruff key mounting pins 36 to rotate, thereby rotating all the other louvers 38 synchronously with the one louver 38 that is being rotated manually by the user.

While the louver strip assemblies 24, 26 have been shown here as being identical, this is not necessarily required. For example, one of the louver strip assemblies 24, 26 may be as described, while other louver strip assembly 24, 26 may not necessarily include a rack subassembly 32.

Also, the extension legs 61, 63 on the louver strip 30 are but one way to accomplish the biasing for pushing the louver strip 30 away from its respective stile 12 or 14. Other biasing means could be employed instead. For example, the stiles themselves may include extension legs, or one or more springs could be placed along the recess 28 of one or both of the stiles 12, 14, between the stile and the louver strip.

Other Embodiments

Figure 6:
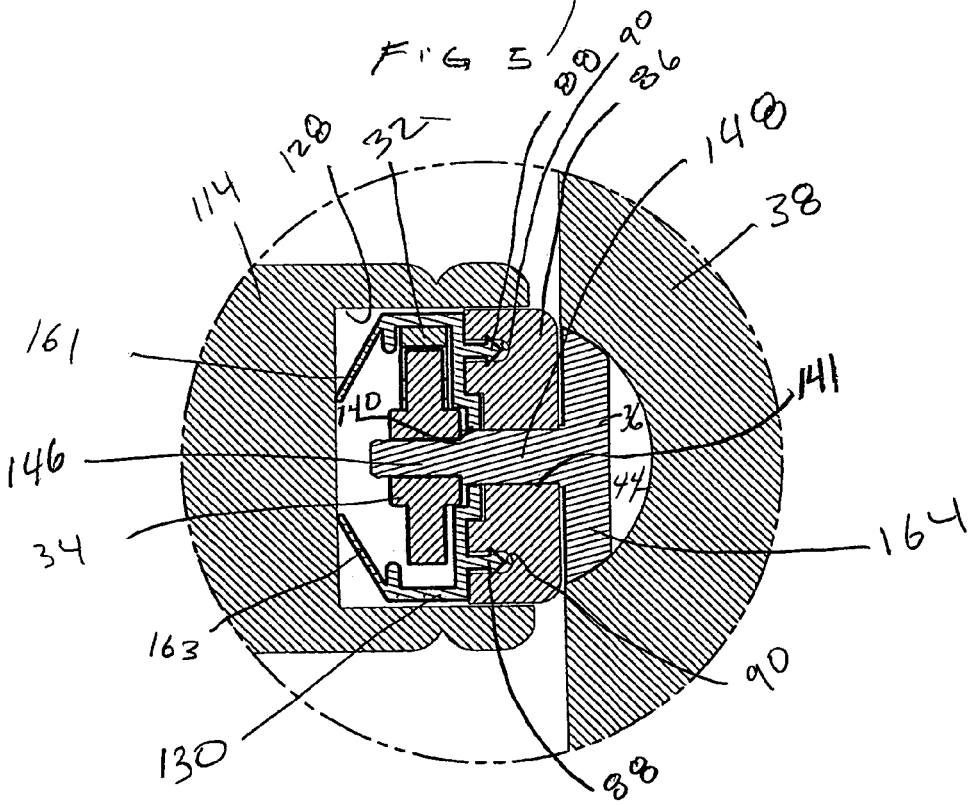
FIG. 6 is an enlarged sectional view, similar to that of FIG. 5, but for the embodiment shown in FIG. 4.
Figure 9:
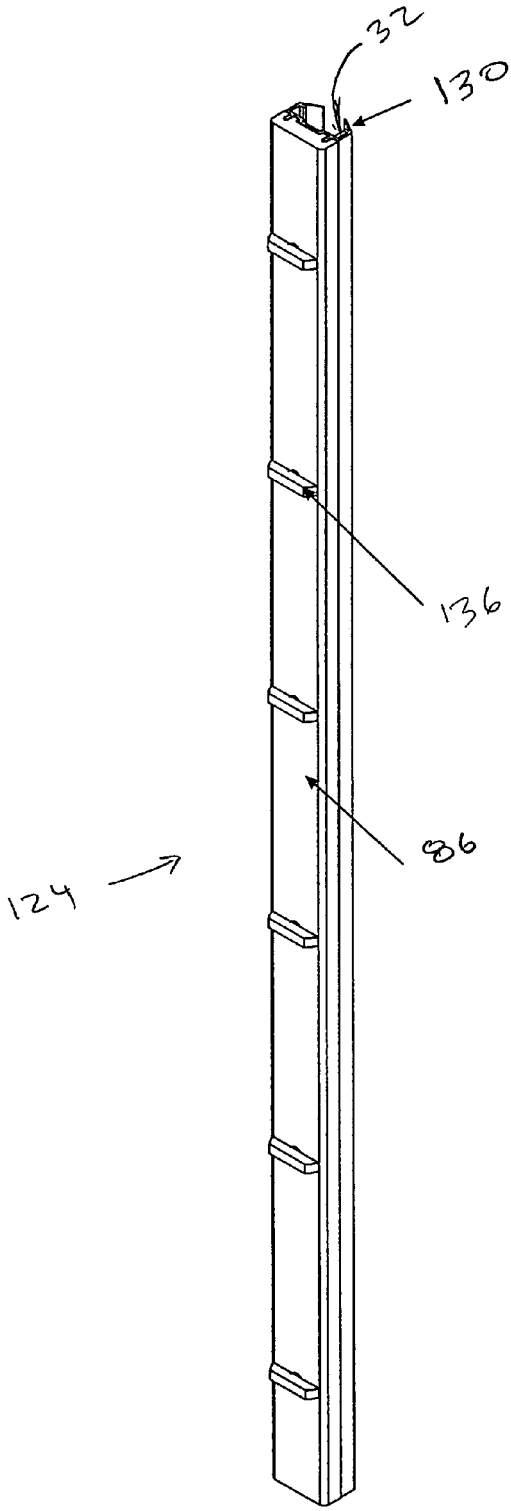
FIG. 9 is a perspective view of the louver strip assembly of the shutter embodiment of FIG. 4 (including the louver strip, the rack, the pinion gears, filler strip, and the louver mounting pins)
Figure 10:
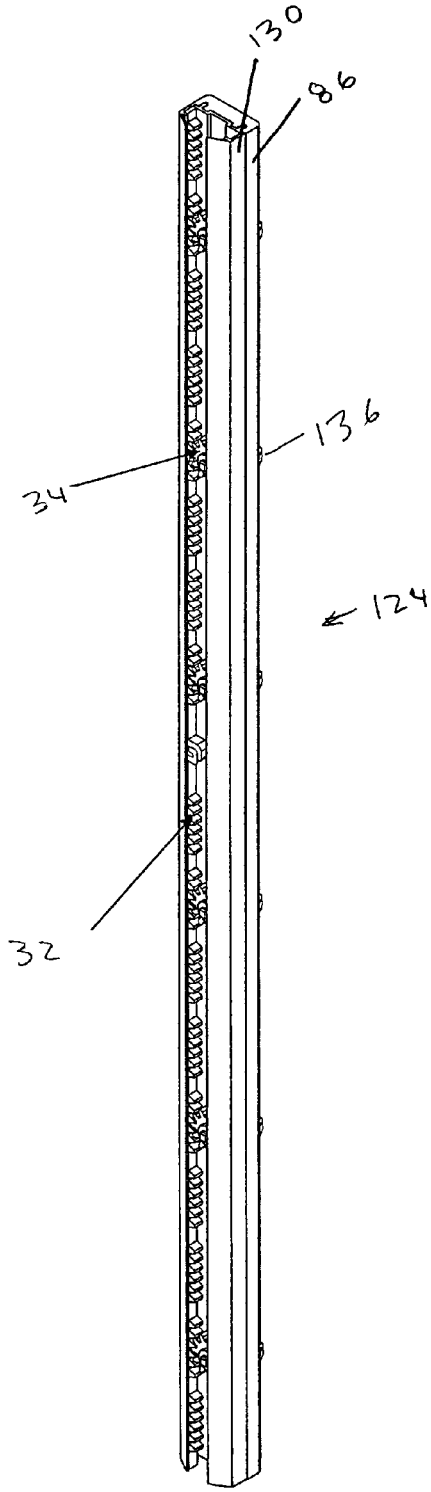
FIG. 10 is a perspective view of the back side of the louver strip assembly of FIG. 9.

FIG. 4 is an exploded perspective view of the right side of a shutter 110 which is similar to the shutter 10 of FIG. 3, except that it includes a filler strip 86 to hide the louver strip 130. For instance, in an all wooden shutter 110, the filler strip 86 may be a wooden strip. This assembly is also shown in FIGS. 6, 9, and 10. In this embodiment, the stiles 112, 114 have a little deeper "U" shaped recess 128 but are otherwise the same as the stiles 12, 14 of the first embodiment. The louver strip 130 is similar to the louver strip 30 of the first embodiment, but, in addition to the elongated ribs described in the first embodiment, it includes two elongated barbed strips 88, which extend the length of the louver strip 130 and project away from the stile, toward the louvers. These barbed strips 88 engage two mating slits 90 on the back of the filler strip 86. When the filler strip 86 is pressed onto the barbed strips 88, interference between the barbed strips 88 and the slits 90 holds the filler strip 86 and the louver strip 30 together. The same rack subassembly 32 and pinion gear 34 is used as in the first embodiment. The filler strip 86 defines holes 141, which correspond to and align with the holes 140 in the louver strip 130.

FIG. 17 shows the woodruff key mounting pin 136 used in this second embodiment of the shutter 110. This woodruff key mounting pin 136 is identical to the woodruff key mounting pin 36 of the first embodiment, except that it has a longer circular cross-section shaft portion 148 to account for the deeper louver strip assembly, which now includes both the louver strip 130 and the filler strip 86. Except for the addition of the filler strips 86 to the louver strip assemblies and the longer woodruff key mounting pins 36, the shutter 110 of FIG. 4 is identical in its assembly and operation to the shutter 10 of FIG. 1.

The louver strip assemblies 24, 26 need not be secured to the stiles 12, 14, since they are eventually trapped between the stiles 12, 14 and the louvers 38. However, it may be desirable to have these louver strip assemblies 24, 26 attached to the stiles 12, 14 so they do not accidentally pop out of the frame during assembly of the shutter 10, 110. Whether or not the louver strip assemblies are attached to their respective stiles, at least one of the louver strip assemblies should have the ability to retract into and be biased outwardly from the recess 28 of its respective stile for installing and removing the louvers 38. Some means to accomplish this are described below.

Figure 11:
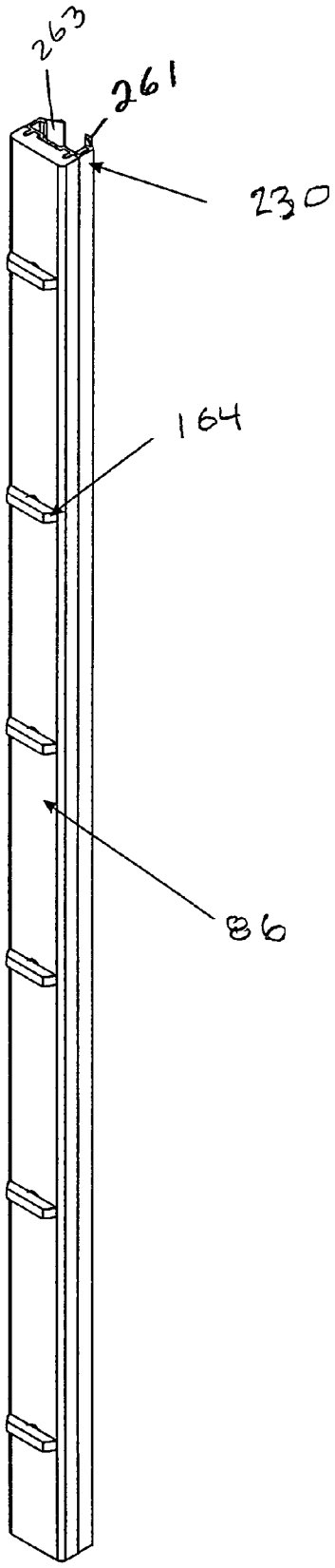
FIG. 11 is a perspective view of a louver strip assembly of yet another embodiment of a shutter made in accordance with the present invention (including the louver strip, the rack, the pinion gears, filler strip, and the louver mounting pins)
Figure 12:
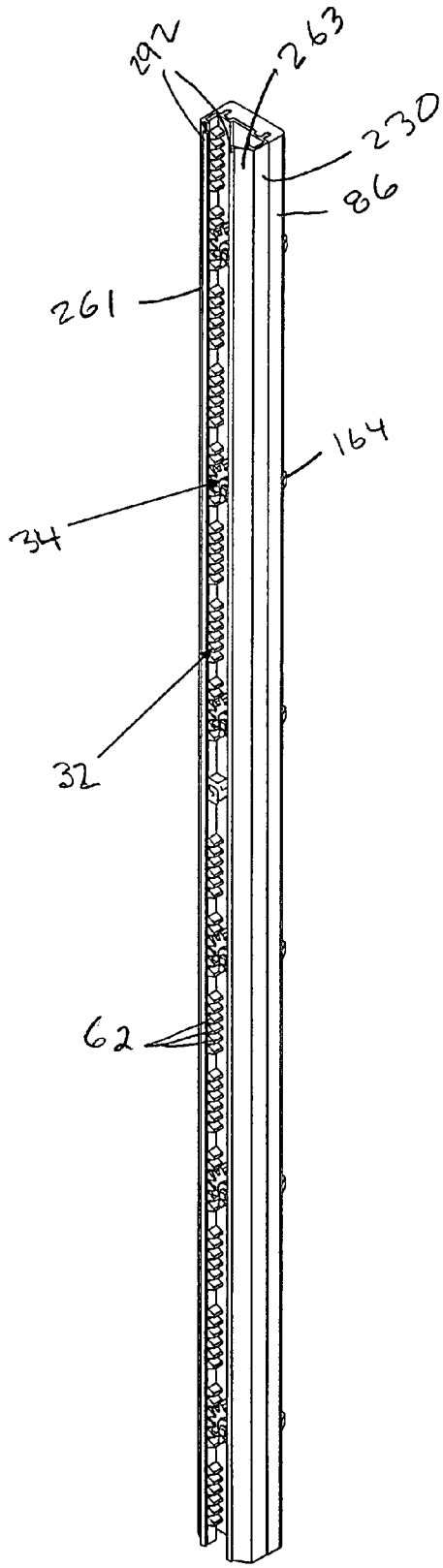
FIG. 12 is a perspective view of the back side of the louver strip assembly of FIG. 11.
Figure 21:
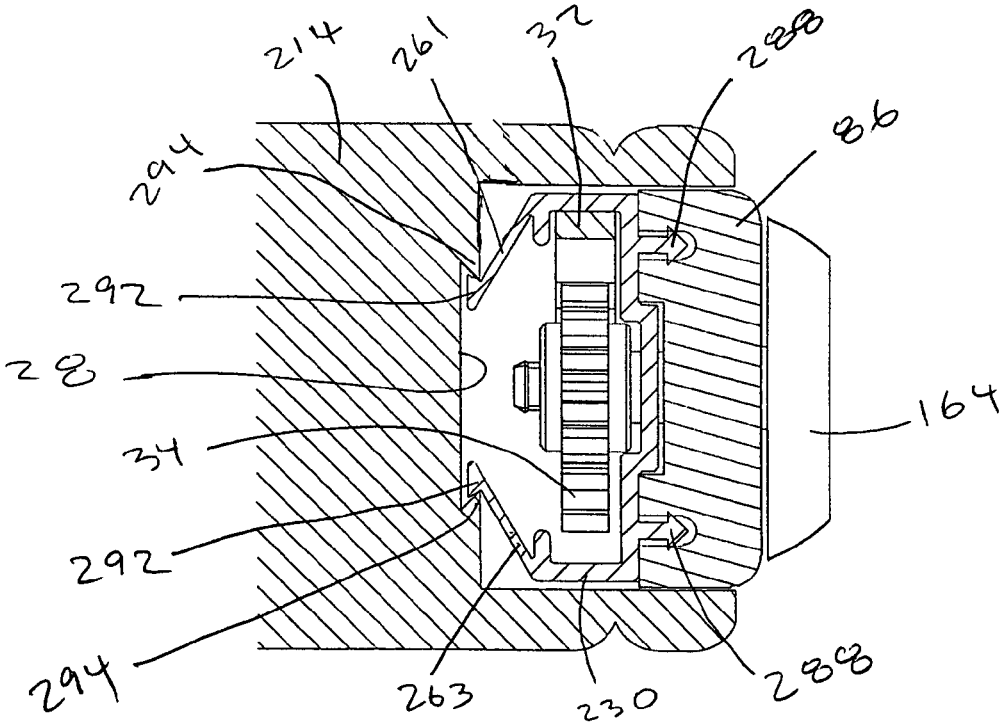
FIG. 21 is a broken away, sectional view, similar to that of FIG. 20, but showing a method for securing the louver strip of FIG. 11 to the stiles.

FIGS. 11, 12, and 21 depict one way to attach the louver strip assemblies to their respective stiles. As shown in FIG. 21, the louver strips 230 include biasing extension legs 261, 263, which terminate in barbs 292 that are received by and that engage projections 294 in the recess 28 of the stile 214 when the extension legs 261, 263 are in the extended position, thus keeping the louver strips 230 "snap-locked" in the recess 28 of the stile 214. The louver strip 230 is able to retract into its stile 214 as its extension legs 261, 263 flex inwardly. It is also able to extend out of its stile 214 until its extension legs 261, 263 are fully extended, at which time its barbs 292 engage the projections 294, preventing further outward movement of the louver strips 230. Since the contact surface between the barbs 292 and the projections 294 is relatively small, and since the extension legs 261, 262 are flexible, it is possible to pull the louver strip 230 of this embodiment away from its stile 214 by pulling hard enough on the louver strip 230, permitting the louver strip assemblies to be removed from the frame of the shutter, if so desired.

Figure 18:
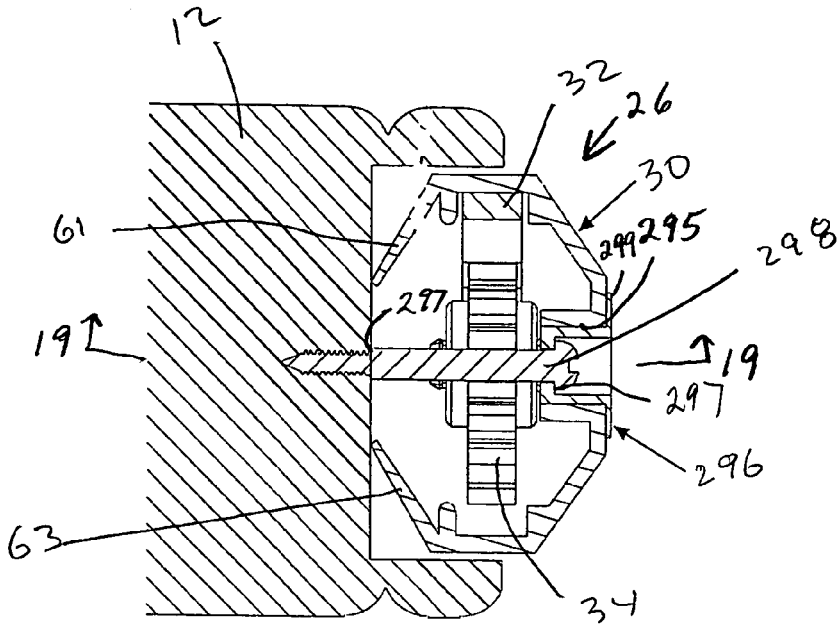
FIG. 18 is a broken away, view, similar to that of FIG. 5, but taken through a shoulder screw that is used to mount the louver strip to the stile, and with the louver removed for clarity.
Figure 19:
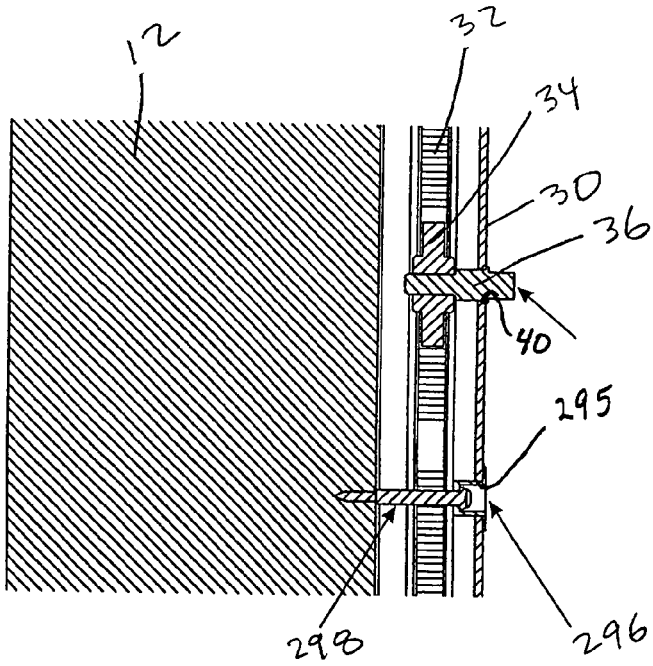
FIG. 19 is a broken-away view taken along line 19-19 of FIG. 18.

FIGS. 18 and 19 show another way to attach the louver strip assemblies 24, 26 to their respective stiles 12, 14 while enabling the louver strip assemblies 24, 26 to shift horizontally with and against the biasing force for installation and removal of the louvers 38. Holes 295 are drilled through the louver strip 30 (preferably at locations in between the mounting pin holes 40), and bushings 296, having outer shoulders 299, are installed in these holes 295. A shoulder screw 298 is inserted through each of the bushings 296 and is threaded into its respective stile 12 (or 14), tightening until the shoulder 297 of the shoulder screw 298 bottoms out on the stile 12 (or 14), and the head of the shoulder screw 298 abuts the smaller diameter inner end 297 of the bushing 296, when the louver strip 30 is at its extended position. The louver strip 30 can then be pushed outwardly toward its stile 12, with the bushings 296 moving relative to the shoulder screws 298. Thus, the louver strip 30 can retract and extend as required for installing and removing the louvers 38, but the louver strip 30 is retained within the recess 28 of its stile 12 (or 14), extending out only as far as the biasing extension legs 61, 63 and the shoulder screws 298 will allow.

Figure 20:
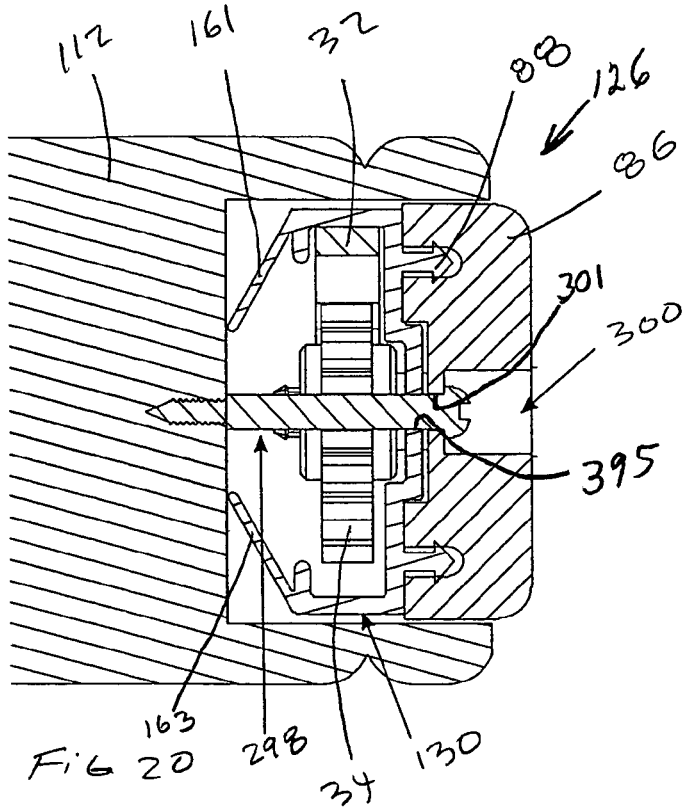
FIG. 20 is a broken away, sectional view, similar to that of FIG. 18, but showing a method for securing the louver strip of FIG. 9 to the stiles.

FIG. 20 depicts a similar means to attach the louver strip assemblies to the stiles, but for the embodiment which includes a filler strip 86. In this instance, a bushing is not used. Instead, a hole 301 with a recessed counterbore 300 is drilled through the filler strip 86 to match up with each of the holes 395 drilled through the louver strip 130 for receiving the shoulder screws 298. A shoulder screw 298 is inserted through each aligned set of holes 301, 395 and is threaded into the respective stile. The head of the shoulder screw 298 is larger than the diameter of the hole 301 in the filler strip, so it abuts against the filler strip 86, securing the filler strip and louver strip 130 to the respective stile. Thus, the entire louver strip 130 and filler strip 86 assembly is able to retract and extend as required for installing and removing the louvers 38, but the louver strip 130 and the filler strip 86 are held within the recess 28 of the respective stile, extending out only as far as the extension legs 161, 163 and the shoulder screws 298 will allow.

Figure 26:
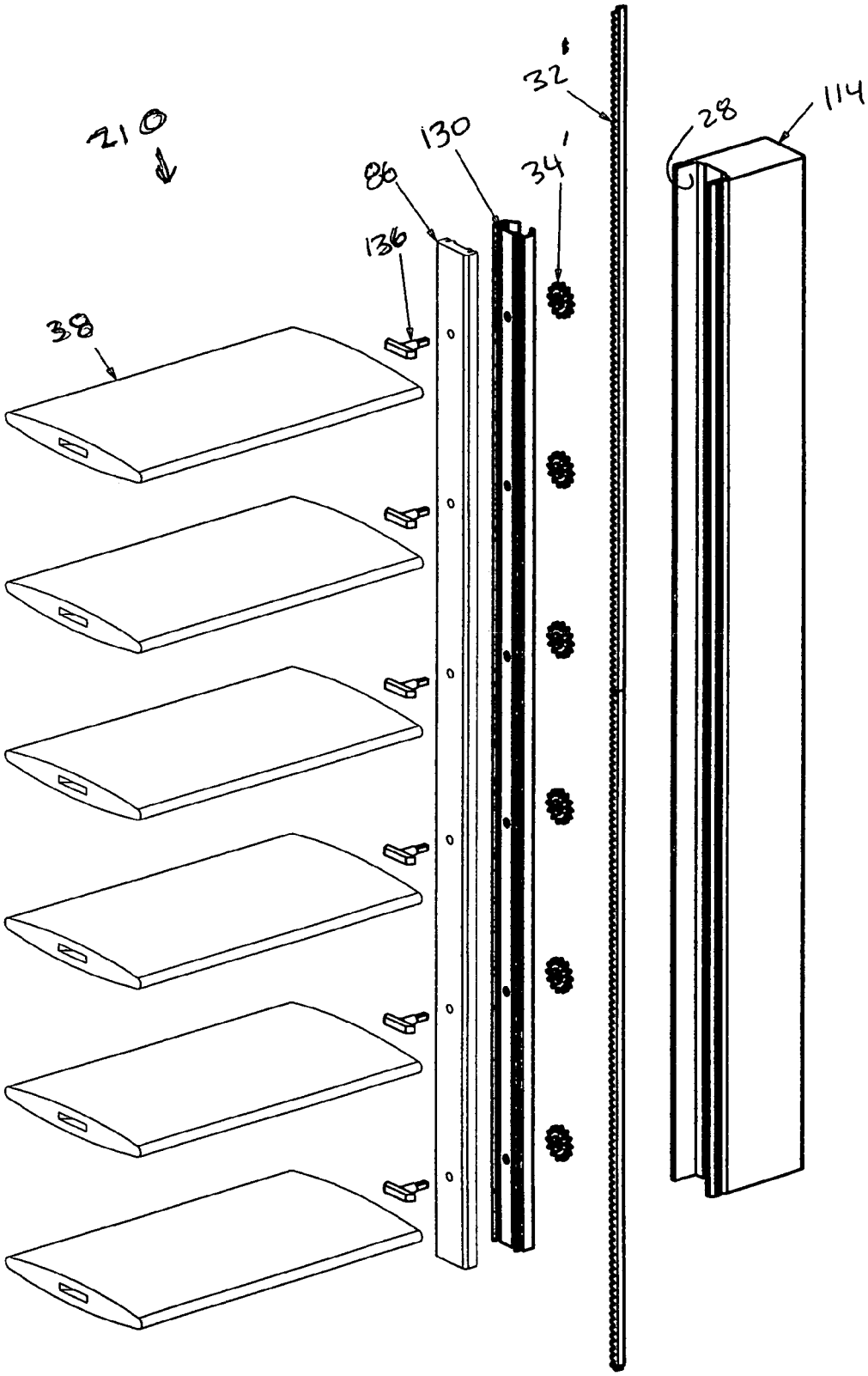
FIG. 26 is a broken away, exploded perspective view, similar to that of FIGS. 3 and 4, of another embodiment of a shutter made in accordance with the present invention.
Figure 27:
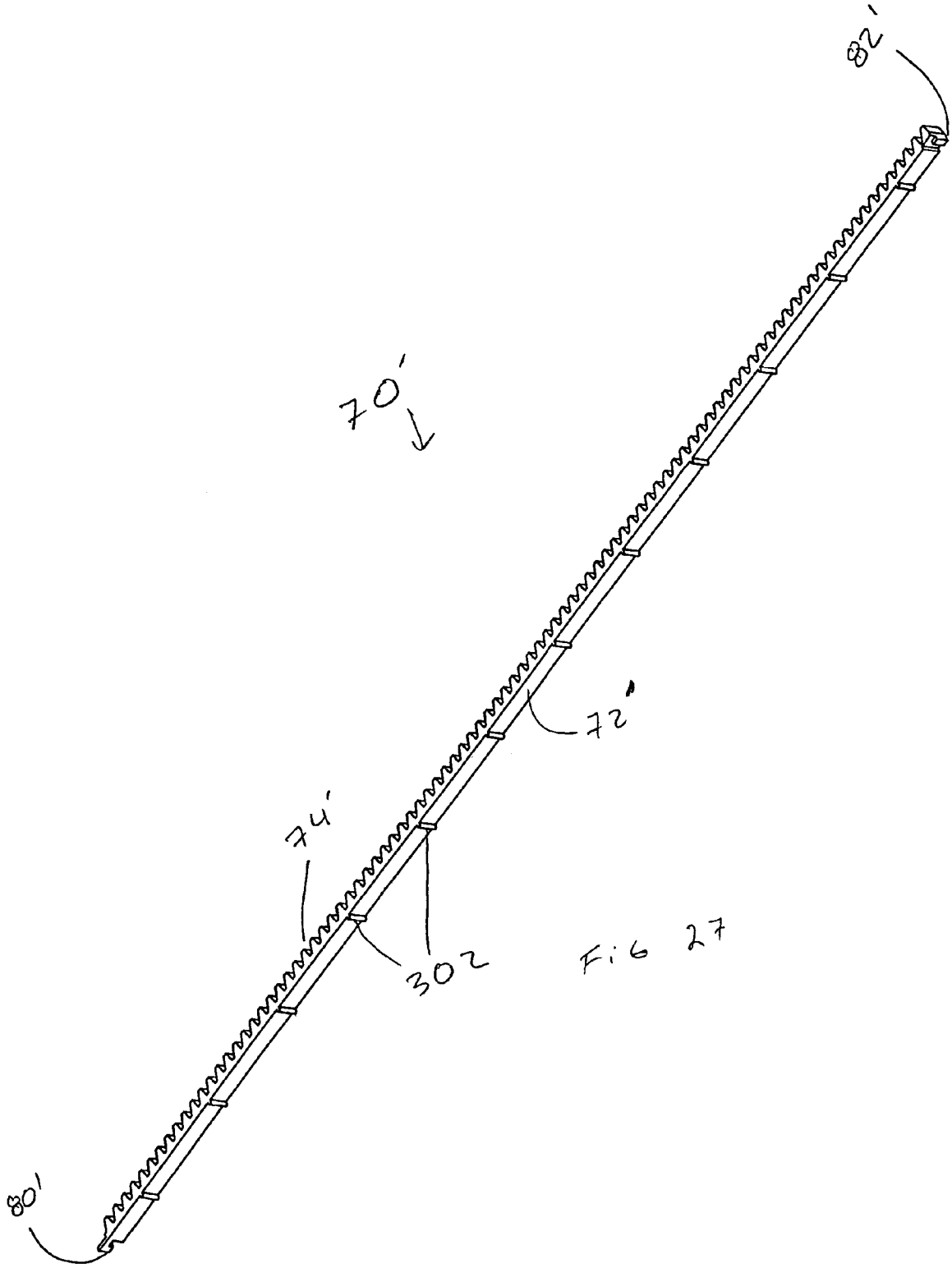
FIG. 27 is a perspective view of the rack used in the shutter of FIG. 26.
Figure 28:
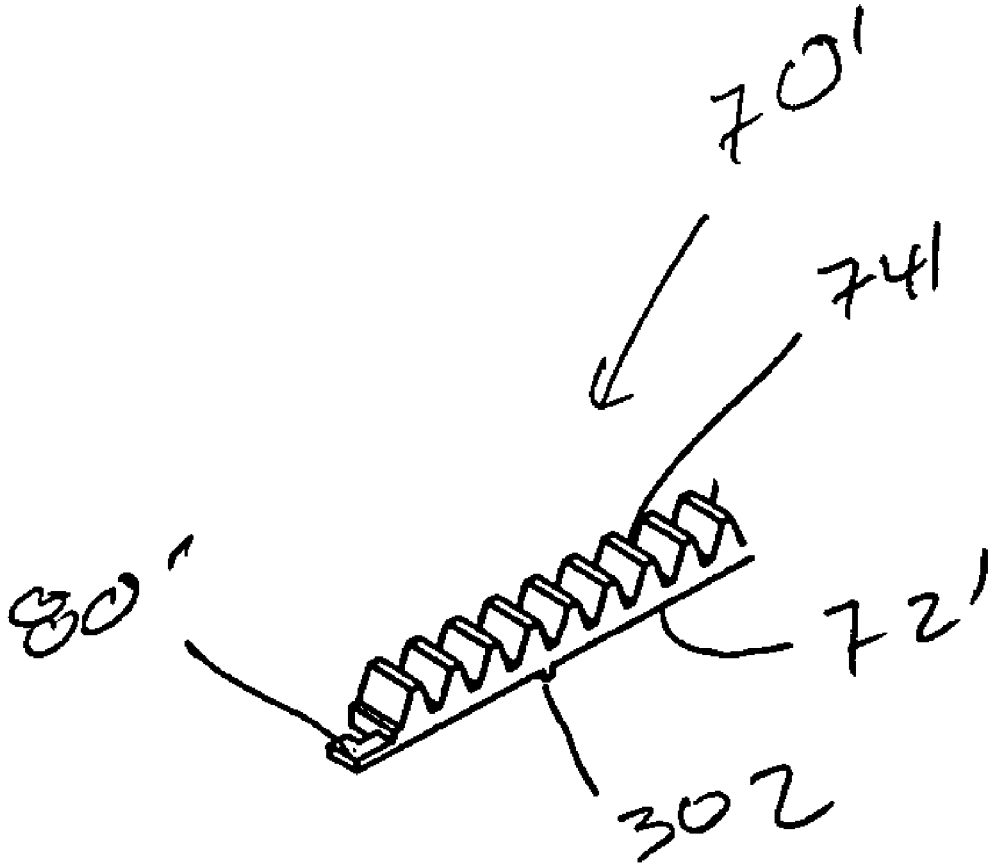
FIG. 28 is a perspective, broken away view of one end of the rack of FIG. 27.
Figure 29:
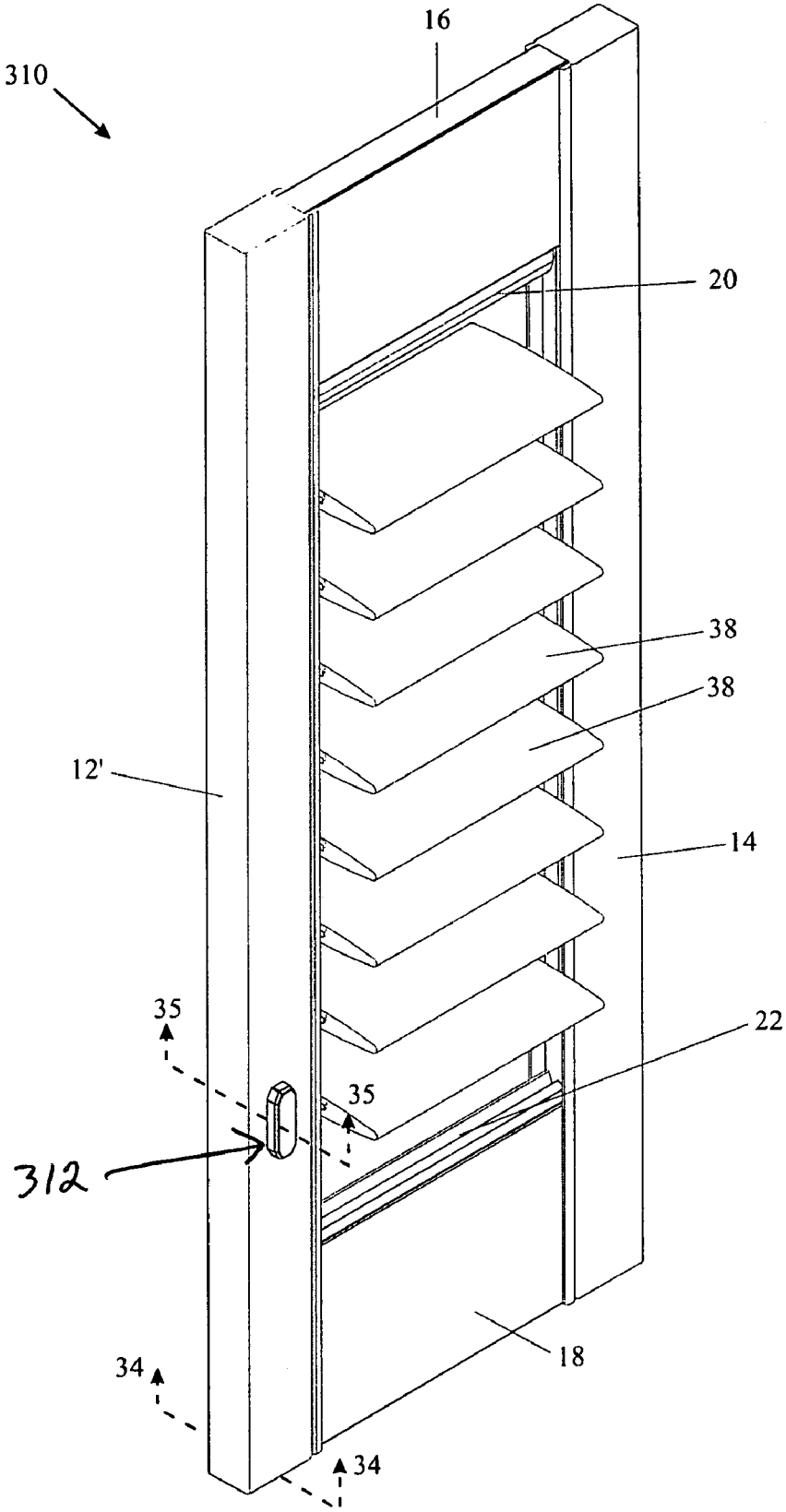
FIG. 29 is a perspective view of another embodiment of a shutter made in accordance with the present invention, shown with a slide operator for opening and closing the louvers.

FIG. 26 shows another embodiment of a shutter 210 made in accordance with the present invention. This shutter 210 is identical to the shutter 110 of FIG. 3, except that the rack assembly 32' is a continuously toothed rack assembly 32' instead of having alternating toothed sections with spaces or gaps between toothed sections. The continuously toothed rack assembly 32' is assembled from a plurality of interconnected rack segments 70' (See FIG. 27), which are very similar to the first embodiment, except that they have a continuous set of teeth 74' on one side and a smooth surface 72' on the other side. The smooth surface 72' is interrupted by rearward projections 302. In this embodiment, the projections 302 are relatively rigid and serve as spacers, providing room to allow flexing of the rack between the projections 302. Alternatively, the projections 302 could be more flexible, which would allow for flexing along the entire rack. The hooked projections and hooked receptacles 80, 82 of the rack 70 are replaced by hooked projections 80' (See detail in FIG. 28) and hooked receptacles 82', which are disposed so as not to interfere with the continuity of the teeth 74' of the assembled rack 32'.

The gears 34' are practically identical to the gears 34 of previous embodiments 10, 110, except that the gear 34' has a diametrical pitch to fit the pitch of the rack segments 70'. In this embodiment, the rack segments 70' have a rack pitch of ⅛ inch. The rack pitch of ⅛ inch allows customization of the shutter 210 by permitting the placement of louvers 38 anywhere within ⅛ increments. This capability may eliminate the need for using adjustable light stops 20, 22 and still be able to customize the height dimension of the shutter 210.

The projections 302 are spaced at approximately 1 inch intervals and allow a "clutching" action useful for "timing" the louvers 38. In this embodiment 210, the alignment position of the pins 136 relative to each other is not as important as it is in the previously described embodiments 10, 110. Once the shutter 210 is assembled, all the louvers 38 may be aligned simply by rotating all the louvers 38 to the fully closed position (whether fully closed room-side up or room-side down). The projections 302 on the smooth back side of the rack 32' provide some "give" to the rack 32' so that it flexes enough for the gears 34' to skip over one or more of the teeth 74' until all of the louvers 38 are aligned relative to each other.

Except for the differences discussed above (namely the continuously toothed rack assembly 32', the self-timing feature of the rack assembly 32' thanks to the projections 302, and the spur gear 34' with a diametrical pitch to fit the rack pitch of 0.125 inches), the shutter 210 is similar to and operates in the same manner as the previously described shutters 10, 110. Again, the design allows for the easy installation and removal of the louvers 38 without the need for any tools.

Shutter with Slide Activator

FIGS. 29 through 37 depict another embodiment of a shutter 310 made in accordance with the present invention. This shutter 310 is very similar to the shutter 110 (See FIG. 4) described earlier, including upper and lower rails 16, 18, left and right stiles 12', 14, upper and lower light stops 24, 22, filler strips 86, louvers 38, and louver strips 130' (which are slightly different from the louver strips 130 as is described later). However, this shutter 310 also includes a slide activator 312 for opening and closing the shutter. As better seen in FIGS. 30 and 31, the slide activator 312 includes a slide 314, a slide holder 316, and a cap 317. The slide activator 312 is used to open and close the louvers 38 as described below.

Figure 30:
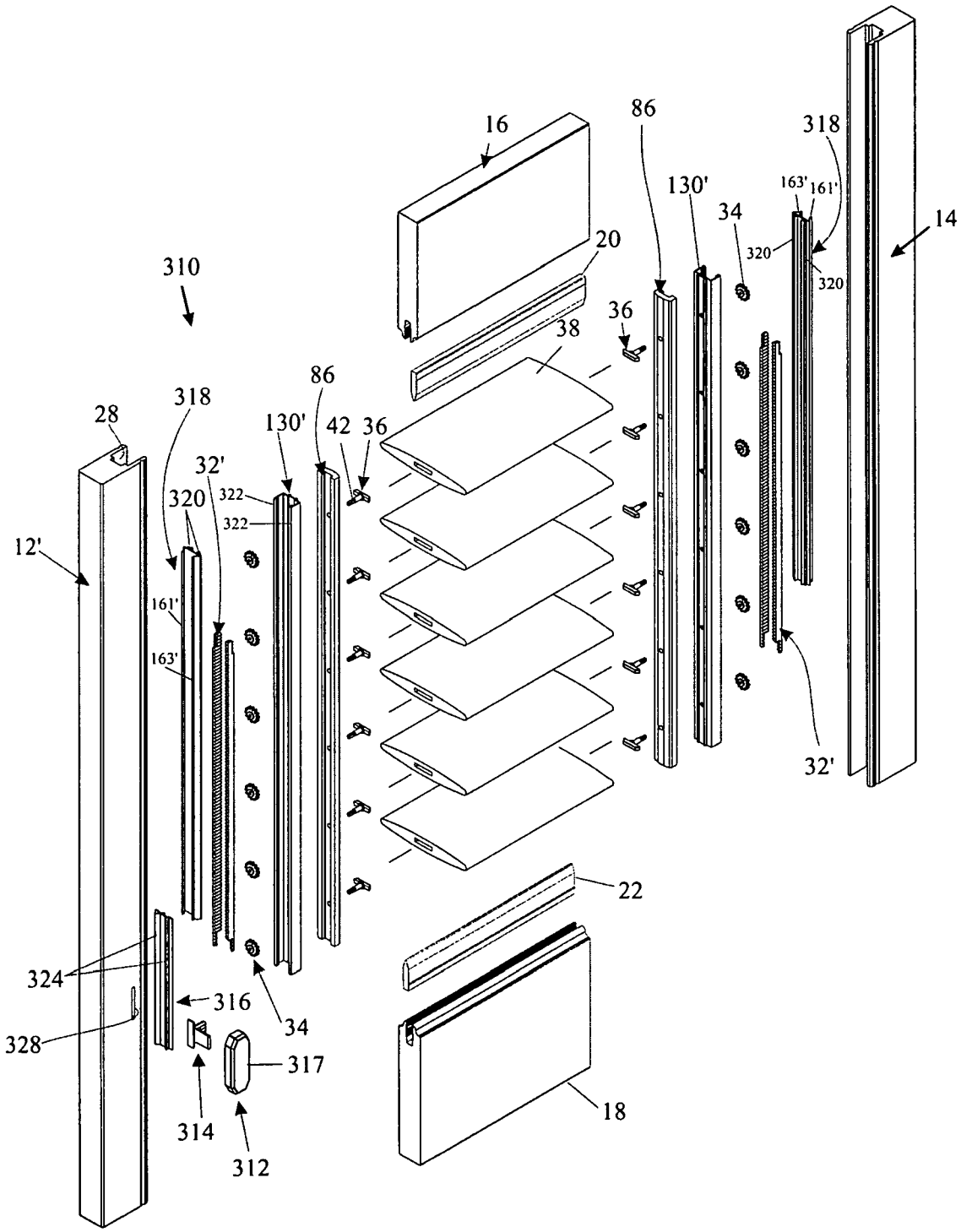
FIG. 30 is an exploded, perspective view of the shutter of FIG. 29.

This embodiment also differs from the previous embodiments in that the biasing legs are found on a separate biasing strip 318, which lies between the louver strip 130' and the stile 12'. Referring briefly to FIG. 30, and comparing this to FIG. 4, it may be appreciated that the louver strip 130 of FIG. 4 is replaced by the combination of the louver strip 130' and the biasing strip 318 of FIG. 30, wherein the biasing strip 318 incorporates the flexible leg extensions 161', 163', which serve the same purpose as the flexible leg extensions 161, 163 (See FIG. 6) of the louver strip 130 of the other embodiment, namely for biasing the louver strip assembly inwardly and allowing the louver strip assembly to be pushed into the "U"-shaped recess 28 of the stiles 12', 14 for installation or removal of the louvers 38. Barbed extensions 320 on the biasing strip 318 engage lips 322 on the louver strips 130' to releasably secure the louver strip 130' to the biasing strip 318 such that the entire louver strip assembly moves in and out of the recess 28 in the stiles 12', 14 as a single unit.

Figure 35:
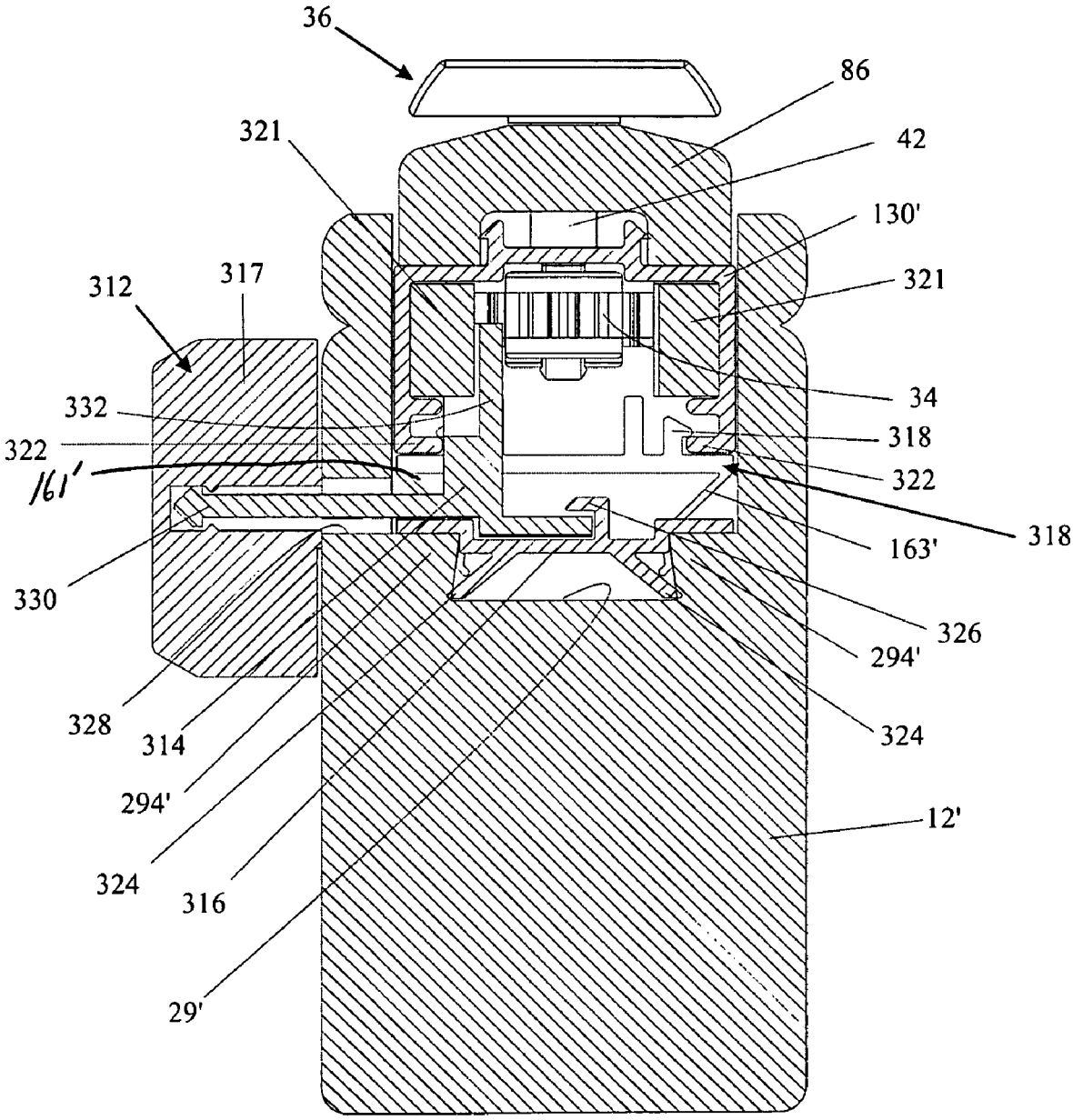
FIG. 35 is a sectional view of the left stile of the shutter of FIG. 29, taken along line 35-35 of FIG. 29.
Figure 36:
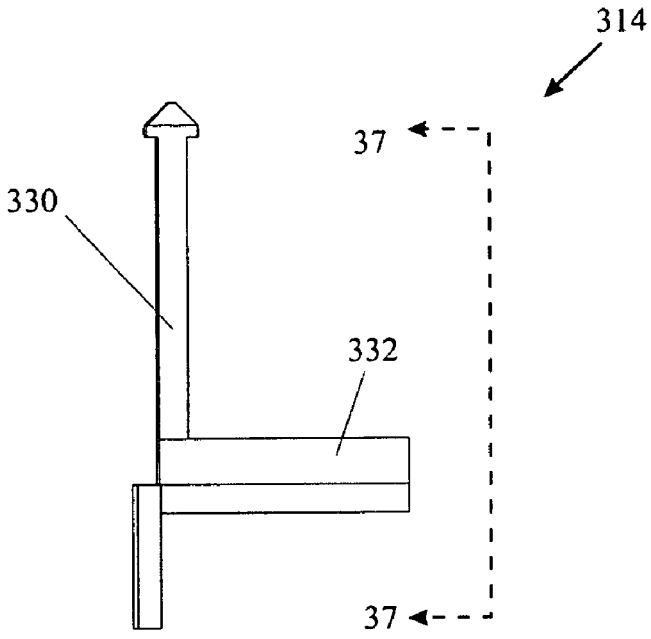
FIG. 36 is an end view of the slide of FIGS. 30 and 31.

Comparing FIG. 21, showing an earlier embodiment, with FIG. 35, showing this embodiment, it may also be appreciated that the projections 294' in the style 12' of this embodiment are much deeper and wider than the projections 294 in the stile 214 of the earlier embodiment, creating a second, stepped recess 29' in the style 12'.

Figure 31:
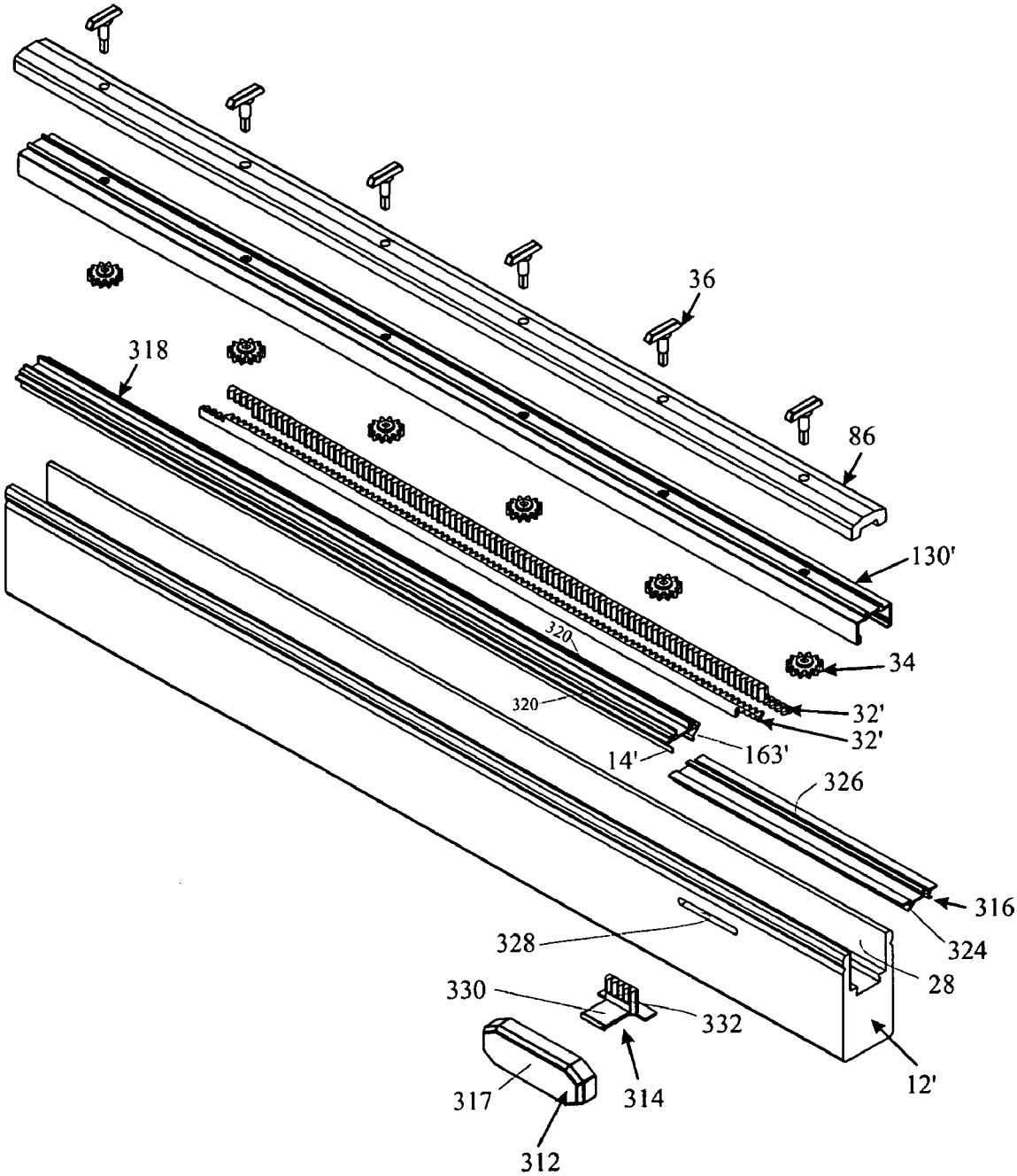
FIG. 31 is an enlarged, detailed, perspective view of some of the components shown in FIG. 30.
Figure 34:
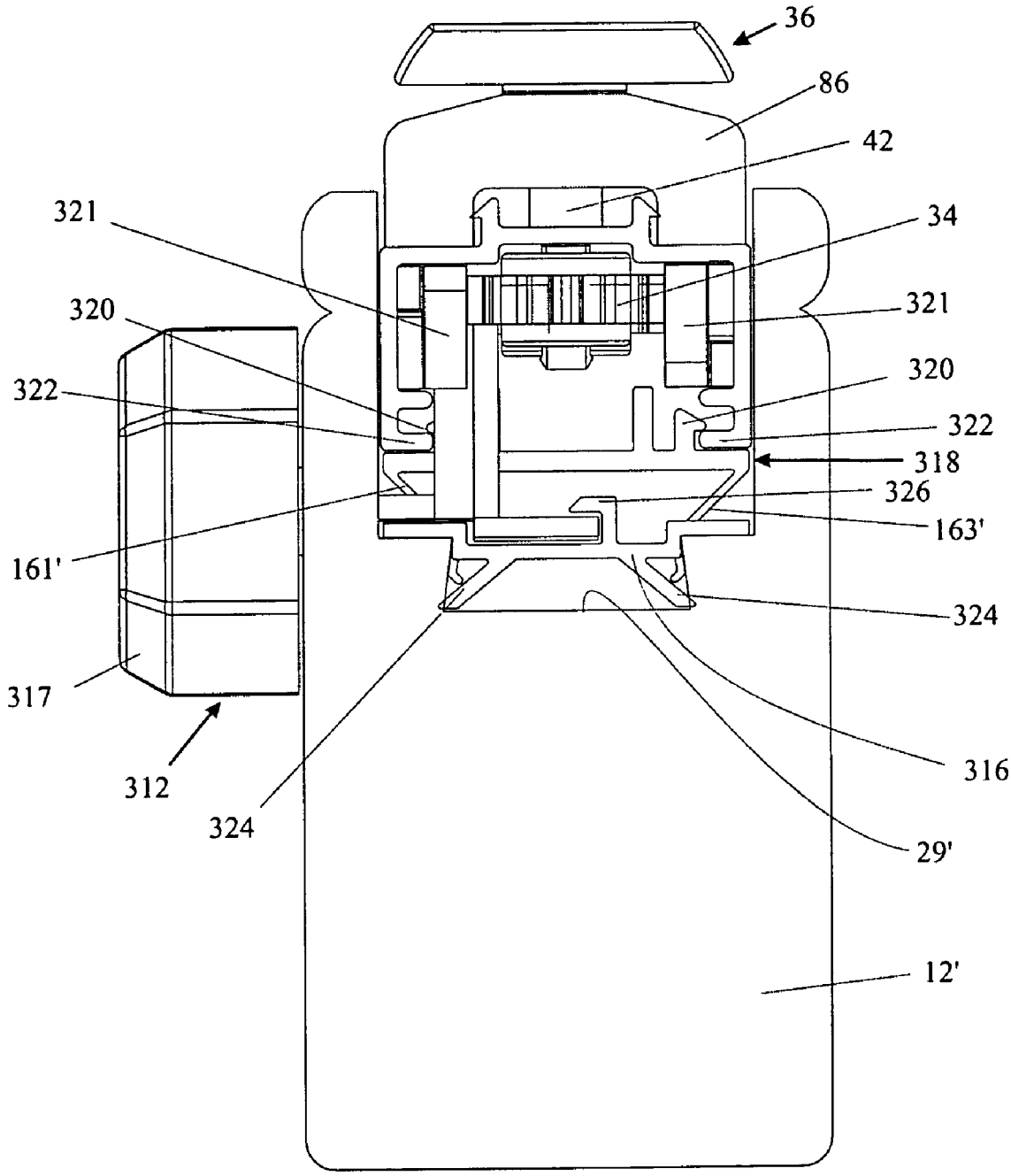
FIG. 34 is a view of the left stile of the shutter of FIG. 29, taken along line 34-34 of FIG. 29.

As shown in FIGS. 31, 34, and 35, the slide holder 316 includes two leg projections 324, which snap into the stepped recess 29' to secure the slide holder 316 to the style 12'. The slide holder 316 also includes a hooked finger 326, which, together with the main body of the slide holder 316, defines a "C" channel for slidably securing the slide 314. It should be noted that other means for retaining the slide 314 while permitting relative motion between the slide and the slide holder may be used. Also, the friction of the sliding motion may be reduced by using rollers or bearings for a rolling/sliding action.

As seen in FIGS. 31 and 35, one side of the style 12' defines a slotted, through-opening 328 through which one leg 330 of the slide 314 extends from the inside of the style 12', terminating in a barbed end, which engages the cap 317. It may be noted that the cap 317 is not strictly necessary, as the user could just as readily grasp the slide leg 330 and move it vertically to tilt the louvers, as discussed in more detail below. The cap 317 simply provides a larger object for the user to grasp, and it also serves to hide the slotted opening 328, so it is not visible to the user.

Figure 37:
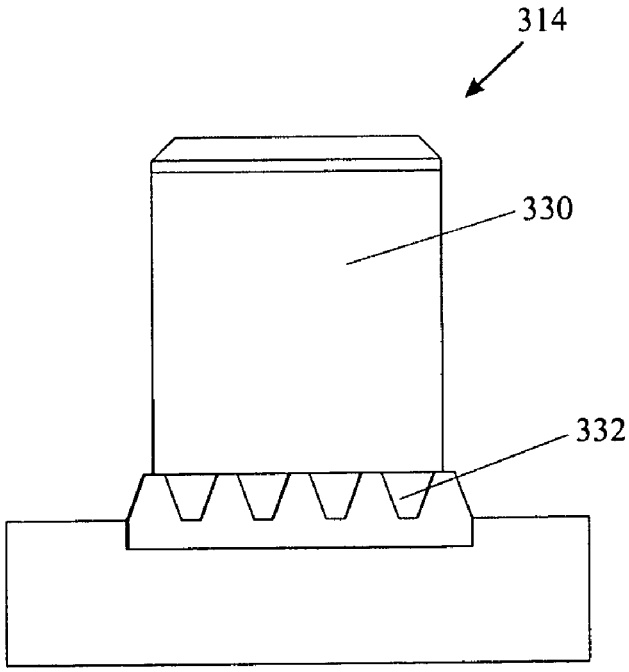
FIG. 37 is a view along line 37-37 of FIG. 36.

Referring briefly to FIGS. 35 and 37, the slide 314 includes a second leg, substantially perpendicular to the first leg 330, and the second leg includes a gear rack 332 which mates up against, and engages one of the rack subassemblies 32' in the shutter 310. (Note that one or two racks 32' may be used in the style 12', as discussed earlier with reference to an earlier embodiment). When the gear rack 332 of the slide 314 engages a rack subassembly 32', the engagement of the teeth in the two racks prevents relative motion between the slide 314 and the gear rack 332.

As the slide 314 is moved vertically along the slotted opening 328, and inside the "C" channel of the slide holder 316, the gear rack 332 of the slide 314 is engaged with and also moves the rack subassembly 32' in the same vertical direction. As described earlier for the first embodiment of a shutter 10, the pinion gears 34 mesh with the rack subassembly 32', and the louver mounting pins 36 (and the louvers 38) rotate with the pinion gears 34. Therefore, the vertical movement of the slide activator 312 causes rotational movement of the louvers 38, tilting the shutter 310 open or closed.

The embodiments described above are simply intended to show examples of preferred shutters made in accordance with the present invention. It will be obvious to those skilled in the art that many modifications may be made to the embodiments described above without departing from the scope of the present invention.

What is claimed is:

1. A shutter, comprising:

first and second vertical stiles and top and bottom rails assembled together to form a frame having an inside and an outside, said first stile defining a first vertically elongated cavity which opens to the inside of said frame;

a first elongated louver strip defining a plurality of spaced-apart holes, said first elongated louver strip being received in said first elongated cavity;

a plurality of first pinion gears mounted between said first elongated louver strip and said first stile, each of said first pinion gears having a pinion gear opening defining an axis of rotation aligned with one of the holes in said first elongated louver strip;

a first elongated rack having a back surface and a toothed front surface, said first elongated rack being received in said first elongated louver strip and said toothed front surface defining teeth which mesh with said plurality of first pinion gears;

a plurality of first pins on which said first pinion gears are mounted for rotation with said first pins, each of said first pins defining first and second ends, said first ends projecting inwardly from said first stile and through one of said louver strip holes;

a plurality of louvers spanning between said first and second vertical stiles, wherein each of said louvers receives the first end of one of said first pins; and means for biasing said louver strip inwardly and for allowing said biased louver strip to be moved outwardly against said biasing means a sufficient distance to permit said louvers to be mounted on and removed from said assembled frame while said louver strip remains mounted on its respective vertical stile.

2. A shutter as recited in claim 1, wherein said second ends of said first pins are retained on said pinion gears.

3. A shutter as recited in claim 2, wherein said first pins are retained on said pinion gears by being snap fit through said pinion gear openings, and wherein said first pins further include keys at their first ends, and said louvers define keyholes, which receive said keys.

4. A shutter as recited in claim 1, wherein said rack comprises a plurality of interconnected rack segments.

5. A shutter as recited in claim 1, and further comprising a filler strip between said first louver strip and said louvers, wherein said first pins extend through said filler strip.

6. A shutter as recited in claim 1, wherein the axes of rotation of said first pinion gears are fixed relative to said first stile, and said elongated rack is vertically movable relative to said first stile.

7. A shutter as recited in claim 3, wherein said keys are elongated and flat, with tapered ends, and wherein said keyholes are flat, arcuate slots, which allows the keys to be self-centering in the keyholes.

8. A shutter as recited in claim 1, wherein said back surface of said rack defines a plurality of rearwardly directed projections, which provide space to allow flexing of said rack in order to synchronize the timing of said louvers relative to each other.

9. A shutter as recited in claim 1, wherein said biasing means includes flexible extension legs projecting from said first louver strip.

10. A shutter as recited in claim 1, wherein said second stile defines a second vertically elongated cavity which opens to the inside of said frame; and further comprising:

a second elongated louver strip defining a plurality of spaced-apart holes, said second elongated louver strip being received in said second elongated cavity;

a plurality of second pinion gears mounted between said second elongated louver strip and said second stile, each of said second pinion gears having a pinion gear opening defining an axis of rotation aligned with one of the holes in said second elongated louver strip;

a second elongated rack having a back surface and a toothed front surface, said second elongated rack being received in said second elongated louver strip, and said toothed front surface of said second elongated rack defining teeth which mesh with said plurality of second pinion gears;

a plurality of second pins on which said second pinion gears are mounted for rotation with said second pins, each of said second pins defining first and second ends, said second pins projecting through said holes in said second louver strip and extending inwardly from said second stile, and said second pins being retained on said second pinion gears;

wherein each of said of louvers also receives the first end of one of said second pins.

11. A shutter as recited in claim 10, and further comprising means for biasing said second louver strip inwardly and for allowing said biased second louver strip to be moved outwardly against said biasing means a sufficient distance to permit said louvers to be mounted on and removed from said frame while said second louver strip remains mounted on its respective vertical stile.

12. A shutter as recited in claim 1, and further comprising:

an elongated slide holder, said elongated slide holder being received in said first elongated cavity;

a slide, slidably secured in said slide holder, and means for engaging said slide with said first elongated rack such that, when said slide slides along said slide holder, said elongated rack also moves with said slide.

13. A shutter as recited in claim 1, and further comprising means for securing said first elongated louver strip in said first elongated cavity such that said louver strip can move inwardly and outwardly relative to said first stile while being retained on said first stile.

14. A shutter as recited in claim 13, wherein said means for securing said first elongated louver strip in said first elongated cavity comprises at least one shoulder screw slidably engaged through said louver strip and screwed into said first stile.

15. A shutter as recited in claim 14, wherein said shoulder screw includes a head which is recessed into said louver strip.

16. A shutter as recited in claim 13, wherein said means for securing said first elongated louver strip in said first elongated cavity comprises barbs on said louver strip and projections within said cavity.

17. A shutter, comprising:

first and second vertical stiles and top and bottom rails assembled together to form a frame having an inside and an outside, said first stile defining a first vertically elongated cavity which opens to the inside of said frame;

a first elongated louver strip defining a plurality of spaced-apart holes, said first elongated louver strip being received in said first elongated cavity;

a plurality of first pinion gears mounted between said first elongated louver strip and said first stile, each of said first pinion gears having a pinion gear opening defining an axis of rotation aligned with one of the holes in said first elongated louver strip;

a first elongated rack having a back surface and a toothed front surface, said first elongated rack being received in said first elongated louver strip and said toothed front surface defining teeth which mesh with said plurality of first pinion gears;

a plurality of first pins on which said first pinion gears are mounted for rotation with said first pins, each of said first pins defining first and second ends, said first ends projecting inwardly from said first stile and defining elongated flat keys with tapered ends; and a plurality of louvers spanning between said first and second vertical stiles, wherein at least one of said louvers defines an arcuate slotted cavity which receives one of said elongated flat keys.

18. A shutter as recited in claim 17, and further comprising means for biasing said louver strip inwardly and for allowing said biased louver strip to be moved outwardly against said biasing means a sufficient distance to permit said louvers to be mounted on and removed from said frame while said louver strip remains mounted on its respective vertical stile.

19. A shutter, comprising:

first and second vertical stiles and top and bottom rails assembled together to form a frame having an inside and an outside, said first stile defining a first vertically elongated cavity which opens to the inside of said frame;

a first elongated louver strip including a first elongated surface defining a plurality of spaced-apart holes, said first elongated louver strip being received in said first elongated cavity;

a plurality of first pinion gears mounted between said first elongated surface and said first stile, each of said first pinion gears having a pinion gear opening defining an axis of rotation aligned with one of the holes in said first elongated louver strip;

a first elongated rack having a back surface and a toothed front surface, said first elongated rack being received in said first vertically elongated cavity and said toothed front surface defining teeth which mesh with said plurality of first pinion gears;

a plurality of first pins on which said first pinion gears are mounted for rotation with said first pins, each of said first pins defining first and second ends, said first ends projecting inwardly from said first stile and through one of said louver strip holes;

a plurality of louvers spanning between said first and second vertical stiles, wherein each of said louvers receives the first end of one of said first pins; and means for biasing said louver strip inwardly and for allowing said biased louver strip to be moved outwardly against said biasing means a sufficient distance to permit said louvers to be mounted on and removed from said assembled frame while said louver strip remains mounted on its respective vertical stile.

* * * * *